US008561223B2

(12) United States Patent
Sato et al.

(10) Patent No.: US 8,561,223 B2
(45) Date of Patent: Oct. 22, 2013

(54) BATHTUB DEVICE

(75) Inventors: Minoru Sato, Fukuoka-ken (JP); Tomohisa Kato, Fukuoka-ken (JP); Masako Fujita, Fukuoka-ken (JP); Masayuki Mochita, Fukuoka-ken (JP)

(73) Assignee: Toto Ltd, Fukuoka (JP)

( * ) Notice: Subject to any disclaimer, the term of this patent is extended or adjusted under 35 U.S.C. 154(b) by 333 days.

(21) Appl. No.: 13/061,728

(22) PCT Filed: Sep. 3, 2009

(86) PCT No.: PCT/JP2009/065430
§ 371 (c)(1),
(2), (4) Date: Mar. 2, 2011

(87) PCT Pub. No.: WO2010/027025
PCT Pub. Date: Mar. 11, 2010

(65) Prior Publication Data

US 2011/0167554 A1 Jul. 14, 2011

(30) Foreign Application Priority Data

Sep. 3, 2008 (JP) ..... 2008-226041
Nov. 26, 2008 (JP) ..... 2008-300336
Dec. 17, 2008 (JP) ..... 2008-321386

(51) Int. Cl.
*A61H 33/04* (2006.01)

(52) U.S. Cl.
USPC ..... 4/541.6; 601/160

(58) Field of Classification Search
USPC ..... 4/541.1–541.6; 601/160, 157
See application file for complete search history.

(56) References Cited

U.S. PATENT DOCUMENTS 5,457,826 A * 10/1995 Haraga et al. ..... 4/541.4

FOREIGN PATENT DOCUMENTS

| | | | |
|---|---|---|---|
| JP | 02-001272 | A | 1/1990 |
| JP | 03-016568 | A | 1/1991 |
| JP | 2710829 | A | 10/1997 |
| JP | 2003-236014 | A | 8/2003 |
| JP | 2005-287541 | A | 10/2005 |
| JP | 2007-268094 | A | 10/2007 |
| JP | 2008-048967 | A | 3/2008 |

OTHER PUBLICATIONS

International Search Report for PCT/JP2009/065430 dated Oct. 13, 2009.

* cited by examiner

*Primary Examiner* — Gregory Huson
*Assistant Examiner* — Janie Christiansen
(74) *Attorney, Agent, or Firm* — Pearne & Gordon LLP

(57) ABSTRACT

According to one aspect of the invention, there is provided a bathtub device including a bathtub 2, a jetting unit 3, a jetting driving unit 4, and a controller 5. The bathtub includes a first bathtub wall surface and a second bathtub wall surface opposed to the first bathtub wall surface. The jetting unit is provided in the second bathtub wall surface and configured to jet a jet flow to a sole of a bather bathing in the bathtub. The jetting driving unit is connected to the jetting unit and configured to adjust jetting flow rate of the jet flow jetted from the jetting unit. The controller is configured to control the jetting driving unit. The controller is configured to control the jetting driving unit to cause the jetting unit to intermittently jet the jet flow with a strength, a leg of the bather being passively bent by the jet flow with the strength.

7 Claims, 27 Drawing Sheets

FIG. 6A
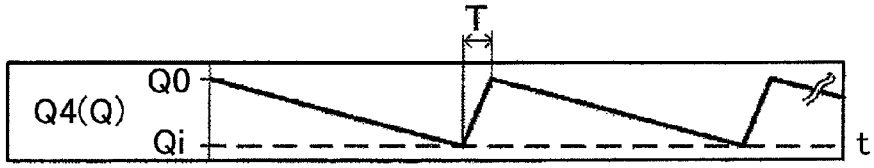
FIG. 6B
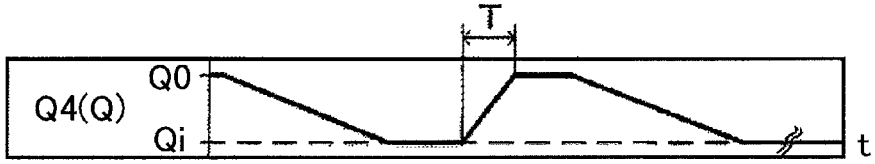
FIG. 6C
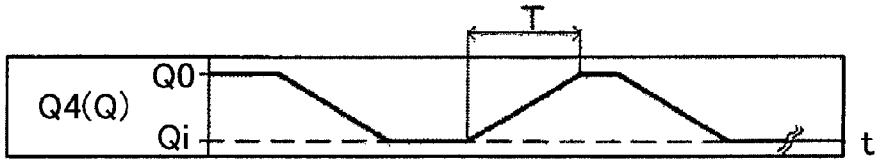
FIG. 6D
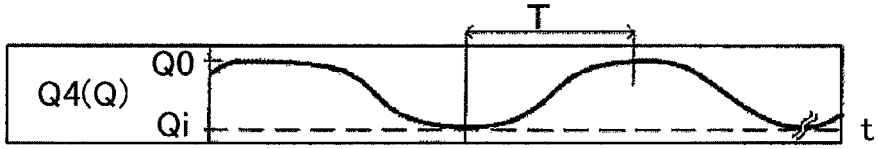
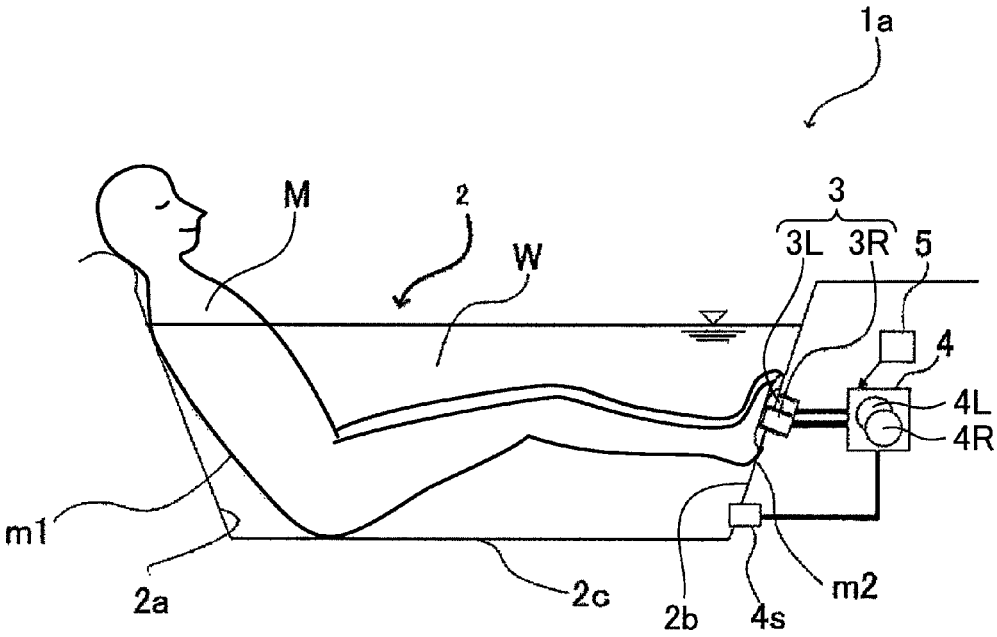
FIG. 7

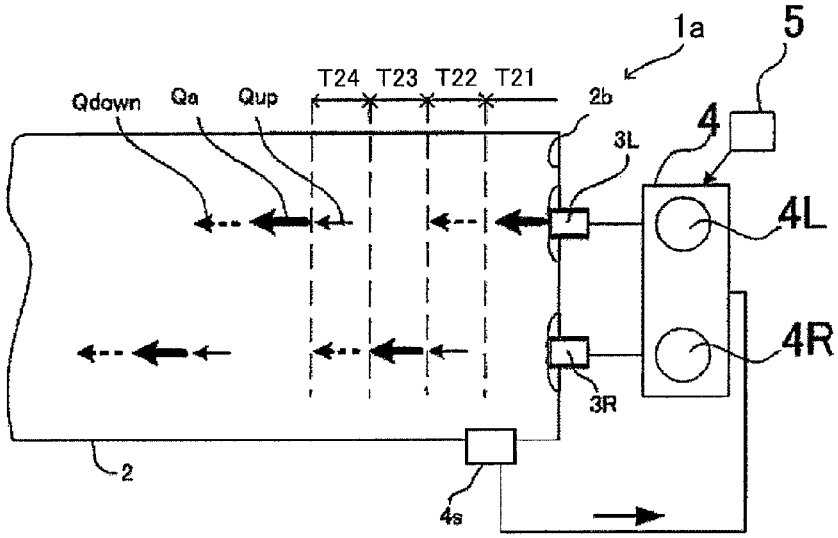
FIG. 8
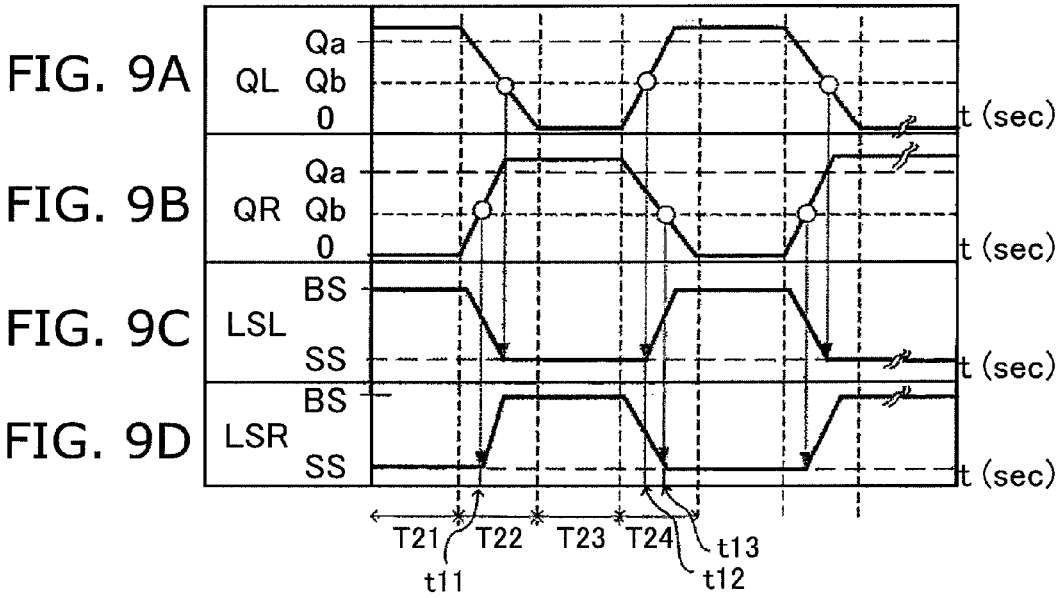

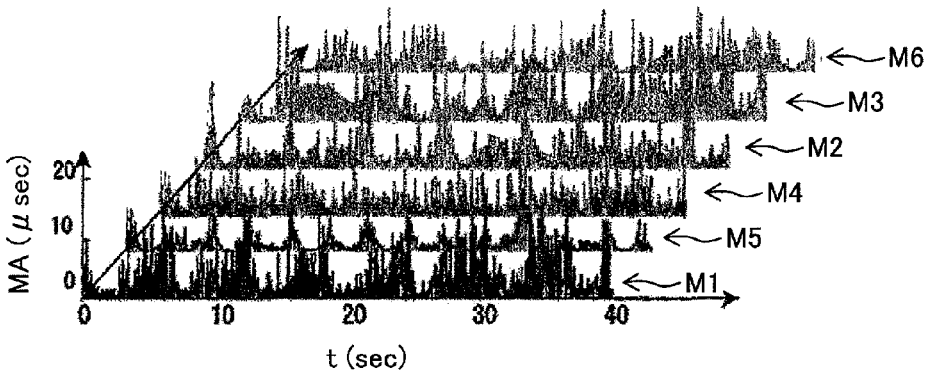
FIG. 11
FIG. 12A
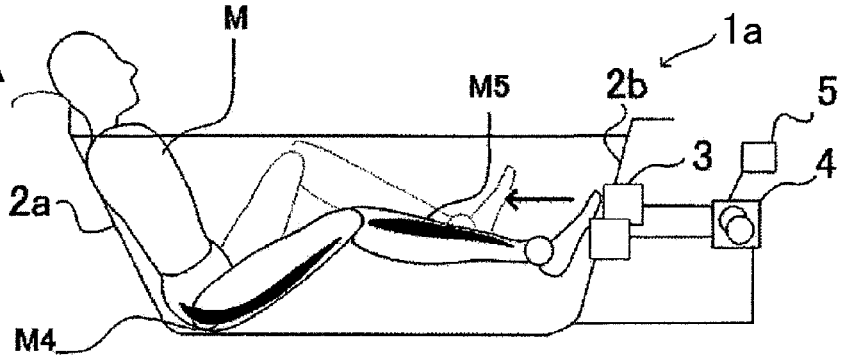
FIG. 12B
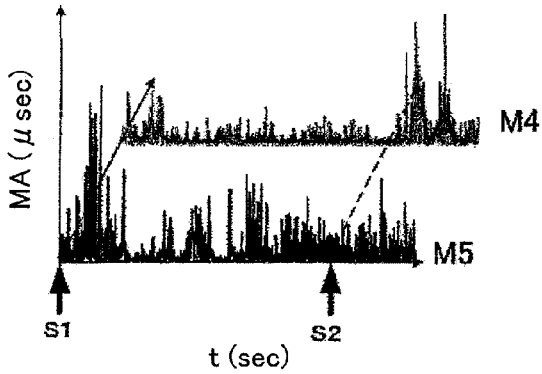

QL

QR

| | PS | PL |
|---|---|---|
| P1 | n4,n5 | n7 |
| P2 | n5 | n6,n7 |
| P3 | n5 | n6 |
| P4 | n4,n5 | n6 |
| P5 | n5 | n5,n6 |
| P6 | n5 | n5,n6 |
| P7 | n4 | n6,n7 |

| DR | Q | EM | | | |
|---|---|---|---|---|---|
| | | PA | PB | PC | PD |
| 30% | | | E1 | E1 | E1 |
| 40% | | E1 | | | |
| 50% | | | E2 | | E2 |
| 60% | | E2 | E2 | E2 | |
| 70% | | | | | |
| 80% | | E3 | | E3 | E3 |

QR QL

FIG. 32

| | DR | | |
|---|---|---|---|
| | 30 ~ 40% | 50 ~ 60% | 70 ~ 80% |
| P1 | n3 ~ n7 | n4,n5 | n4,n5 |
| P2 | n3 ~ n7 | n4,n5 | n4 |
| P3 | n3 ~ n7 | n4,n5,n6 | n4 |
| P4 | n3 ~ n7 | n4,n5 | n4 |
| P5 | n3 ~ n7 | n4,n5,n6 | n4 |
| P6 | n3 ~ n7 | n4,n5,n6 | n4 |
| P7 | n3 ~ n7 | n4,n5 | n4,n5 |

BATHTUB DEVICE

TECHNICAL FIELD

An aspect of this invention relates to a bathtub device, and more particularly to a bathtub device causing a bather to exercise.

BACKGROUND ART

Recently, there has been a growing interest and demand for health and relaxation. Home bathtub products equipped with jet bath functionality are widely on the market. Jet bath products are mainly intended to provide the bather with massage, fatigue recovery, and healing by water jets.

For instance, Patent Document 1 discloses a technique for generating a unidirectionally flowing uniform flow which directly and continuously impinges on the bather. The bather's body surface is stimulated by the uniform flow impinging on the bather allowed to fall in a state of complete relaxation.

For instance, Patent Document 2 describes, instead of a uniform flow, use of a water circulator pump with variable rotation speed to control the jetting amount and jetting pressure of flowing water.

For partial massage, Patent Document 3 discloses a circulation type bathtub including a footrest inside the bathtub and a jetting port for squirting a jet flow at this footrest.

On the other hand, there are proposals for providing exercise in the bathtub. Patent Document 4 discloses a technique for providing a depressible pedal in the bathtub. The pedal is provided with depression load by a spring. The bather can exercise by depressing the pedal with one foot while keeping a sitting posture.

Patent Document 5 discloses a bubble generating device in which squirt and stop of a jet flow from a jet nozzle are controlled by a controller. According to Patent Document 5, the bathing water is simultaneously squirted from two squirting positions during a certain overlap time. This allows smooth shift from one squirting position to another, and the bather feels no discomfort by the shift. However, like the circulation type bathtub disclosed in Patent Document 2, this bubble generating device is not a device which causes the bather to exercise.

PRIOR ART DOCUMENT

Patent Document

[Patent Document 1] JP-A 2-1272 (1990)
[Patent Document 2] JP-A 3-16568 (1991)
[Patent Document 3] JP-A 2005-287541
[Patent Document 4] JP-A 2003-236014
[Patent Document 5] Japanese Patent No. 2710829

DISCLOSURE OF INVENTION

Technical Problem

As described above, jet bathing in most home bathtubs is intended for massage to the bather by water flow, and aims to control the flow rate for the massage effect. Thus, there are few intended for muscle strengthening. On the other hand, for a person with no exercise habits, the technique for providing a depressible pedal in the bathtub requires considerable will power to exercise for oneself. In particular, a person during bathing is in a relaxed mental state, and hence it is difficult to exert the will power. Thus, it is anticipated that exercise does not last long even if an exercise machine is installed in the bathtub. Another problem is the inconvenience of attachment and detachment of the exercise machine.

An object of the invention is to provide a bathtub device capable of causing a bather to exercise continually.

Technical Solution

According to one aspect of the invention, there is provided a bathtub device including a bathtub including a first bathtub wall surface and a second bathtub wall surface opposed to the first bathtub wall surface; a jetting unit provided in the second bathtub wall surface and configured to jet a jet flow to a sole of a bather bathing in the bathtub; a jetting driving unit connected to the jetting unit and configured to adjust jetting flow rate of the jet flow jetted from the jetting unit; and a controller configured to control the jetting driving unit, the controller being configured to control the jetting driving unit to cause the jetting unit to intermittently jet the jet flow with a strength, a leg of the bather being passively bent by the jet flow with the strength.

Effect of Invention

According to the invention, a bathtub device capable of causing a bather to exercise continually can be realized.

BRIEF DESCRIPTION OF DRAWINGS

FIGS. 6A to 6D illustrate jetting states which the jetting driving unit according to the embodiment of the invention can generate.

FIG. 7 is a schematic cross-sectional view illustrating a bathtub device according to the embodiment of the invention.

FIG. 8 is a schematic plan view illustrating the operation of the bathtub device according to the embodiment of the invention.

FIGS. 9A to 9D show the relationship between the jetting flow rate of the bathtub device according to the embodiment of the invention and the state of the leg of a bather.

FIG. 11 shows the muscle activity of a bather in the bathtub device according to the embodiment of the invention.

FIGS. 12 A and 12B illustrate the locations of muscles of a bather in the bathtub device according to the embodiment of the invention and the activities thereof.

FIG. 32 illustrates results of experimental use of the bathtub device according to the embodiment of the invention.

BEST MODE FOR CARRYING OUT THE INVENTION

Figure 1:
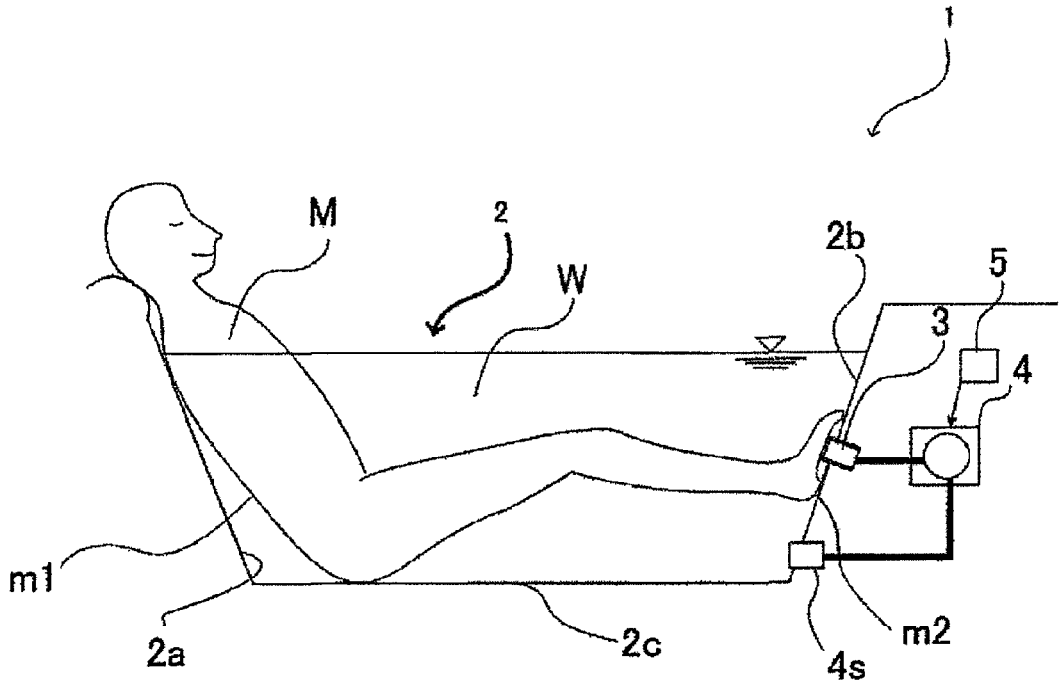
FIG. 1 is a schematic cross-sectional view illustrating a bathtub device according to an embodiment of the invention.

The first invention is a bathtub device including a bathtub including a first bathtub wall surface and a second bathtub wall surface opposed to the first bathtub wall surface; a jetting unit provided in the second bathtub wall surface and configured to jet a jet flow to a sole of a bather bathing in the bathtub; a jetting driving unit connected to the jetting unit and configured to adjust jetting flow rate of the jet flow jetted from the jetting unit; and a controller configured to control the jetting driving unit, the controller being configured to control the jetting driving unit to cause the jetting unit to intermittently jet the jet flow with a strength, a leg of the bather being passively bent by the jet flow with the strength.

This bathtub device can cause a bather to exercise continually.

The second invention is the bathtub device of the first invention, wherein the jetting unit includes a first jetting unit configured to jet the jet flow to a left sole of the bather and a second jetting unit configured to jet the jet flow to a right sole of the bather and the controller causes the first and second jetting units to jet the jet flow with the strength, the left and right legs of the bather being passively bent by the jet flow with the strength.

This bathtub device can place the left and right legs of the bather in different states. Hence, the bather can be caused to do an underwater walking motion closer to gait motion even in a sitting posture, for instance. Thus, the effect of exercise can be further improved.

The third invention is the bathtub device of the second invention, wherein the controller causes the first and second jetting units to alternately jet the jet flow with the strength, the left and right legs of the bather being passively bent by the jet flow with the strength.

This bathtub device can cause the bather to do an underwater walking motion closer to gait motion. Thus, the effect of exercise can be further improved.

The fourth invention is the bathtub device of the second invention, wherein the controller controls the jetting driving unit so that state of the left and right legs of the bather includes a state of the left and right feet of the bather being simultaneously spaced from the first jetting unit and the second jetting unit when the left and right legs of the bather are passively bent and stretched.

This bathtub device can create a state of both soles being separated from the jetting units, and hence can create an exercising state closer to the actual gait motion.

The fifth invention is the bathtub device of the second invention, wherein the jetting driving unit includes a first jetting driving unit connected to the first jetting unit and a second jetting driving unit connected to the second jetting unit.

In this bathtub device, it is easier to control the amount of water jetted from the first jetting unit and the second jetting unit.

The sixth invention is the bathtub device of the second invention, wherein the first jetting unit and the second jetting unit are a pair of jetting units arranged horizontally.

In this bathtub device, when the bather exercises, the left and right legs in the stretched state are located at a nearly equal height from the bottom surface of the bathtub. This can realize a natural posture of the bather.

The seventh invention is the bathtub device of the third invention, wherein the controller is capable of setting a state of the jet flow jetted from the jetting unit to a first jet flow state not bending the leg of the bather, and a second jet flow state having a higher jetting flow rate than the first jet flow state and bending the leg of the bather, and capable of varying duration of at least one of the first and second jet flow states.

In this bathtub device, by varying the jetting time of at least one of the first and second jet flow states, the bather can change among various exercise modes to do stepping exercise and walking exercise. Thus, the bather can continue these exercises without being bored with exercise. That is, it can be said that this bathtub device is an exercise bathtub device capable of causing a bather to passively exercise while allowing the bather in the sitting state.

The eighth invention is the bathtub device of the seventh invention, wherein the controller is capable of varying ratio of the duration of the first and second jet flow states to cycle of change of the state of the jet flow jetted from the jetting unit.

In this bathtub device, by varying the ratio of jetting time of the first and second jet flow state to the cycle of the state of jet flow jetted from the jetting unit, the bather can change among an exercise similar to stretching exercise, a bending/stretching exercise like walking exercise, and an exercise similar to balance training. Thus, the bather can continue these exercises without being bored with exercise.

The ninth invention is the bathtub device of the seventh invention, wherein the controller is capable of varying the cycle of change of the state of the jet flow jetted from the jetting unit.

In this bathtub device, by varying the cycle of the state of jet flow jetted from the jetting unit, the bather can change between an exercise similar to stretching exercise or balance training, and a bending/stretching exercise like walking exercise. Thus, the bather can continue these exercises without being bored with exercise.

Embodiments of the invention will now be described with reference to the drawings.

First Embodiment

FIG. 1 is a schematic cross-sectional view illustrating a bathtub device according to this embodiment.

The bathtub device 1 includes a bathtub 2. The bathtub 2 has a generally rectangular solid shape, for instance. The inner side surface of one longitudinal end of the bathtub 2 is a first bathtub wall surface 2*a*. On the first bathtub wall surface 2*a*, the bather M can retain a bathing posture and lean at the back m1 (dorsal side) of the bather. A second bathtub wall surface 2*b* is opposed to the first bathtub wall surface 2*a* in the longitudinal direction of the bathtub. The second bathtub wall surface 2*b* is a wall surface with which the sole m2 of the bather M is to be in contact. The first bathtub wall surface 2*a* and the second bathtub wall surface 2*b* are in contact with the bottom surface 2*c*.

The longitudinal length of the bathtub 2, i.e., the length of the bathtub 2 between the second bathtub wall surface 2*b* and the first bathtub wall surface 2*a*, is such that when a bather M of standard physique in a bathing posture puts the back m1 on the first bathtub wall surface 2*a* of the bathtub 2 and opposes the sole m2 to the second bathtub wall surface 2*b*, the jetting unit 3 can be covered with the sole m2. Here, the buttocks of the bather M are brought into contact with the bottom surface 2*c* of the bathtub 2.

A jetting unit 3 is provided in the second bathtub wall surface 2*b* of the bathtub 2. The jetting unit 3 is connected to a jetting driving unit 4. The jetting driving unit 4 can jet a jet flow to the leg including the sole m2 of the bather M. The direction of the jet flow squirted from the jetting unit 3 is directed from the second bathtub wall surface 2*b* to the first bathtub wall surface 2*a*.

The bathtub device 1 includes a jetting driving unit 4 for generating a jet flow. The jetting driving unit 4 sends a jet flow to the jetting unit 3 connected to the jetting driving unit 4. The suction port 4*s* of the jetting driving unit 4 communicates into the bathtub 2. Thus, the jetting driving unit 4 pumps water W from inside the bathtub 2 to generate a jet flow.

Furthermore, the jetting driving unit 4 adjusts the jetting flow rate (the volume of water jetted per unit time) jetted from the jetting unit 3. The jetting flow rate generated by the jetting driving unit 4 is controlled by the signal of the controller 5 connected to the jetting driving unit 4.

Next, the operation of this embodiment is described with reference to FIG. 1 to FIG. 6D.

As shown in FIG. 1, with water (hot water) W stored in the bathtub 2, a bather M gets in the bathtub 2 and assumes a bathing posture. More specifically, the bather M brings the buttocks into contact with the bottom surface 2*c* of the bathtub 2, abuts the back m1 on the first bathtub wall surface 2*a* of the bathtub 2, and opposes the soles m2 to the second bathtub wall surface 2*b*. Then, the bather M places a sole m2 so as to cover the jetting unit 3 with the sole m2. Thus, the bather M assumes an initial posture to catch the jet flow jetted from the jetting unit 3 with the sole m2.

At this time, the bather M is in a relaxed state. However, in order that the body of the bather M may not be submerged in the water (hot water) W by the action of buoyancy, the bather M withstands the buoyancy by the legs (soles m2), buttocks, and trunk (back m1). This causes the muscle group around each support point to perform minute muscle activities. However, the activities of these muscle groups are minute and performed unconsciously. Hence, the bather M can easily retain the aforementioned bathing posture as in usual bathing. Furthermore, the action of buoyancy applied to the bather M oneself disturbs the balance of the bathing posture. In response, the bather M performs a compensating motion for unconsciously exerting the muscles throughout the body to stabilize the posture. At this time, muscle activities occur in a wide range of the body of the bather M.

Figure 2:
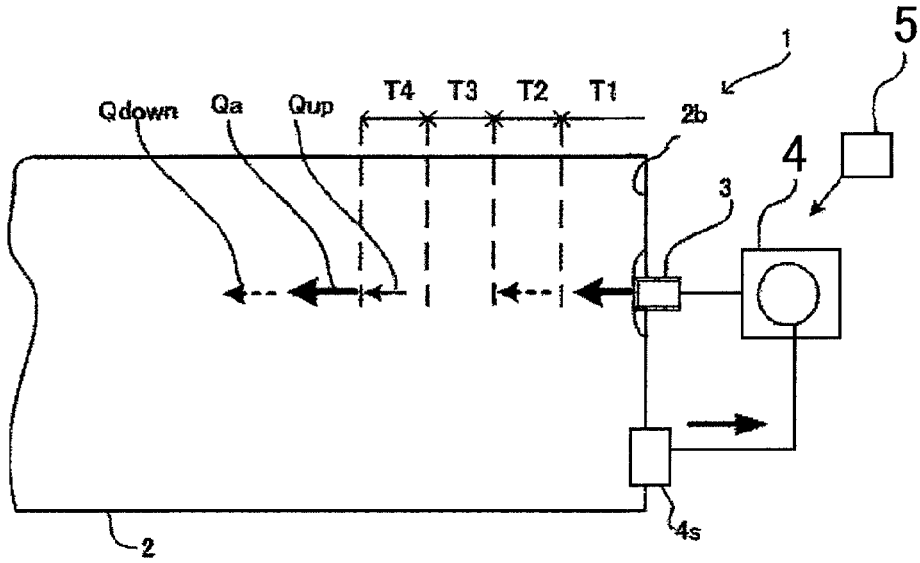
FIG. 2 is a schematic plan view illustrating the operation of the bathtub device according to the embodiment of the invention.

FIG. 2 is a schematic plan view illustrating the operation of the bathtub device 1 according to this embodiment. FIG. 2 shows the operation of adjusting the jetting flow rate of the jet flow between the jet flow states of bending and not bending the leg of the bather M by the jet flow from the jetting unit 3 located so as to be able to face the sole m2.

First, the jetting driving unit 4 and the controller 5 are activated. Thus, the jetting driving unit 4 pumps water in the bathtub 2 from the suction port 4*s* to generate a jet flow. Then, the jetting flow rate of the jet flow generated by the jetting driving unit 4 is adjusted by the jetting driving unit 4 upon receiving the signal (command) from the controller 5.

Upon receiving the signal (command) from the controller 5, the jetting driving unit 4 adjusts the jetting flow rate of jetting water squirted from the jetting unit 3. For instance, the jetting flow rate increases in approximately 0.3 seconds from an initial jetting flow rate of 0 liters/min to a target jetting flow rate of e.g. 135 liters/min.

In the case of requiring higher responsivity, the initial jetting flow rate is preferably made higher than 0 liters/min. For instance, the initial jetting flow rate is set to 30 liters/min so that the foot of the bather M is not separated from the second bathtub wall surface 2*b*. This reduces the start-up time of the jetting driving unit 4. As a result, the jetting flow rate can be adjusted with higher responsivity.

Next, the operating state of jetting of the jetting unit 3 is described with reference to FIG. 2.

In the operating state T1, the jetting unit 3 jets water at a jetting flow rate of a prescribed value Qa or more.

Then, in the operating state T2, the jetting flow rate jetted from the jetting unit 3 is in a jetting state Qdown in which the jetting flow rate is decreased from the value of the prescribed value Qa or more toward the jetting flow rate of not bending the leg of the bather M.

In the operating state T3, the jetting flow rate jetted from the jetting unit 3 is a jetting flow rate of not bending the leg.

Then, in the operating state T4, the jetting flow rate jetted from the jetting unit 3 is in a state Qup in which the jetting flow rate is increased from the jetting flow rate of not bending the leg toward the jetting flow rate of jetting water at the prescribed value Qa or more.

The operating states T1, T2, T3, and T4 are shifted in this order. After the operating state T4, the state returns to the operating state T1. Thus, the operating states T1, T2, T3, and T4 can be repeated cyclically.

Here, the prescribed value Qa refers to a jetting flow rate enough to maintain the bent state of the leg of the bather M.

Here, the "state of not bending" includes not only the state of exactly not bending, but also the "state of placing in a state with a relatively lower degree of bending than the state of bending". That is, the "state of not bending" includes the "state of bending relatively weakly" as opposed to the "state of bending".

Next, the states of the leg of the bather M derived from the aforementioned jetting states are described.

In the operating state T1, when the jetting unit 3 jets water at the prescribed value Qa or more, the leg joints (ankle joint, knee joint, and hip joint) of the bather M are bent. The foot is separated from the second bathtub wall surface 2*b*.

Next, in the operating state T2, the jetting flow rate jetted from the jetting unit 3 is in the jetting state Qdown of decreasing toward a value lower than the prescribed value Qa. The leg joints (ankle joint, knee joint, and hip joint) of the bather M are gradually shifted from the bent state toward the stretched state. The foot moves toward the second bathtub wall surface 2*b*.

In the operating state T3, the jetting flow rate jetted from the jetting unit 3 is in the state of not bending the leg. At this time, the leg joints (ankle joint, knee joint, and hip joint) of the bather M are in the stretched state. The jetting flow rate at this time is in the range from 0 liters/min to a jetting flow rate (e.g., 30 liters/min or less) such that the leg of the bather M is not bent, i.e., the foot is not separated from the second bathtub wall surface 2*b*.

Then, in the operating state T4, the jetting unit 3 jets water in the state Qup of increasing the jetting flow rate. At this time, the leg joints (ankle joint, knee joint, and hip joint) of the bather M are shifted from the stretched state toward the bent state.

Figures 3A, 3B:
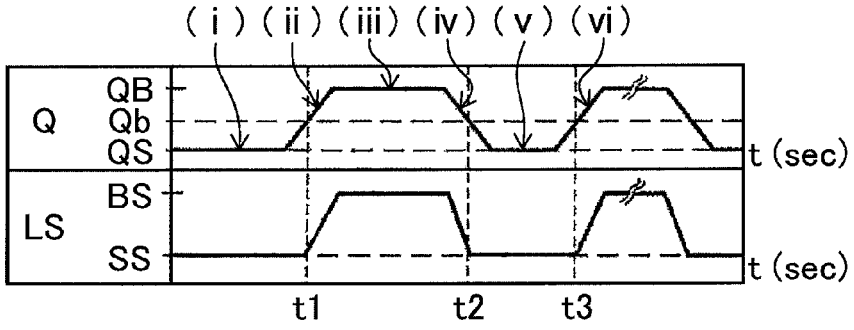
FIGS. 3A and 3B show the relationship between the jetting flow rate of the bathtub device according to the embodiment of the invention and the state of the leg of a bather.

FIGS. 3A and 3B show the relationship between the jetting flow rate of the bathtub device according to the embodiment of the invention and the state of the leg of the bather. More specifically, FIGS. 3A and 3B are graphs illustrating the jetting flow rate and the state of the leg in the bathtub device 1 according to this embodiment, with time t taken on the horizontal axis. The vertical axis of FIG. 3A represents the jetting flow rate Q jetted from the jetting unit 3. The vertical axis of FIG. 3B represents the bent/stretched state LS of the leg.

The temporal variation of the jetting state (jetting flow rate Q) and the bent/stretched state LS of the leg are described with reference to FIGS. 3A and 3B. In the process (ii) and process (vi) of increasing the jetting flow rate Q jetted from the jetting unit 3, the jetting flow rate Q at certain time n and time t3 becomes a prescribed jet flow value Qb or more. At this time, the bather M is placed in the bent state BS of the leg.

Next, in the process (iv) of decreasing the jet flow from the jetting unit 3, at a certain time t2, the jetting flow rate Q becomes lower than the prescribed jet flow value Qb and results in the state of not bending the leg of the bather M.

Here, the prescribed jet flow value Qb is described. If a jetting flow rate Q exceeding the prescribed jet flow value Qb is jetted to the sole m2 of the bather M, the foot is separated from the second bathtub wall surface 2*b* and the jetting unit 3 and shifted toward the bent state BS. On the other hand, if the jetting flow rate Q turns from a value higher than the prescribed jet flow value Qb to a value lower than the prescribed jet flow value Qb, the foot is placed in the state of moving toward the second bathtub wall surface 2*b*. That is, the leg of the bather M start to shift from the bent state BS toward the relatively stretched state SS.

Thus, the controller 5 can bend the leg of the bather M in the process (process (ii) and process (vi)) of increasing the jetting flow rate of jet flow jetted from the jetting unit 3 to a value of the prescribed value Qa or more. Furthermore, the controller 5 can stretch the bent leg of the bather M in the process (process (iv)) of decreasing the jet flow.

The prescribed value Qa of the jetting flow rate jetted from the jetting unit 3 is preferably e.g. 110 liters/min or more. For jetting to move the leg more intensively, the prescribed value Qa is preferably set to 150 liters/min, and more preferably 180 liters/min.

The prescribed jet flow value Qb is set to e.g. 50 liters/min, preferably 80 liters/min, and more preferably 90 liters/min.

However, this embodiment is not limited thereto. The prescribed value Qa and the prescribed jet flow value Qb can be arbitrarily set depending on the size of the bathtub 2 of the bathtub device 1, the amount of water W, the physique of the bather M, and the intended exercising state.

Here, a delay specific to water flow is involved in the temporal variation of the jetting state and the bent/stretched state of the leg. For instance, even if the jetting driving unit 4 is stopped, the jet flow received by the bather M at the sole m2 does not immediately lose the force pressing the sole m2 due to the force of inertia. Therefore, in the motion of bending and stretching the leg, particularly in shifting to the stretched side, the motion of the leg lags behind the jetting time. Hence, such control as announcing the end of exercise using a display unit, for instance, can be realized by a control program for announcing the end of exercise with a delay after finally ending the bending/stretching exercise and ending the control of the jetting driving unit 4. Thus, more comfortable exercise in water can be provided to the user.

Next, the leg bending/stretching exercise of the bather M caused by variation of the jetting flow rate is described with reference to the process (i) to process (iv) of FIGS. 3A and 3B and FIGS. 4A to 4E. FIGS. 4A to 4E are schematic views showing the state of the leg of the bather subjected to jetting water according to the embodiment of the invention.

In the process (i) of FIGS. 3A and 3B, the jetting flow rate Q jetted from the jetting unit 3 is a value QS lower than the prescribed jet flow value Qb, i.e., a jetting flow rate of not bending the leg. At this time, no pressing force, or a force of not bending the leg of the bather M, is applied to the sole m2 of the bather M. At this time, the ankle joint, knee joint, and hip joint of the leg are in the stretched state, and the bather M assumes a posture shown in FIG. 4A, for instance. In this embodiment, the "stretched state of the leg of the bather" refers to the state of the bather naturally stretching the leg, and does not necessarily refer to the state of the joints of the leg completely stretched.

Next, in the process (ii) of FIGS. 3A and 3B, the jetting flow rate Q jetted from the jetting unit 3 is increased to a value of the prescribed jet flow value Qb or more. At this time, the force pressing the sole m2 increases. Hence, as shown in FIG.

4B, the posture of the bather M is gradually shifted from the relatively stretched state SS of the leg joints (ankle joint, knee joint, and hip joint) toward the bent state BS. That is, the posture of the bather M is placed in the state of the foot being moved away from the second bathtub wall surface 2*b*.

Figure 4A:
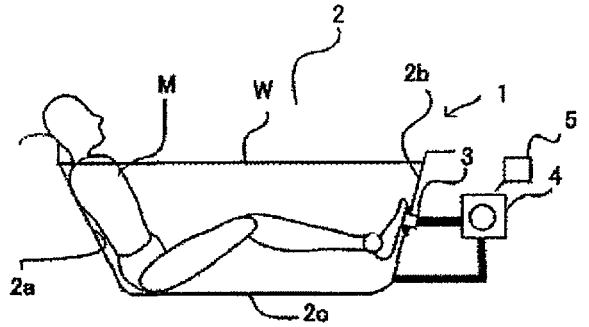
FIGS. 4A to 4E illustrate states of a bather in the bathtub device according to the embodiment of the invention.
Figure 4B:
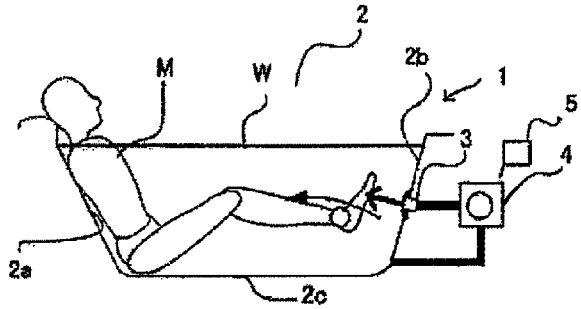
Figure 4C:
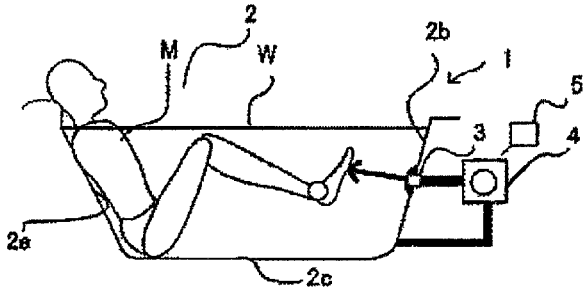

Next, in the process (iii) of FIGS. 3A and 3B, the jetting flow rate Q jetted from the jetting unit 3 becomes a value QB of the prescribed value Qa (not shown) or more and results in the jet flow state in which the leg is retained in the bent state. At this time, the bather M assumes a posture of retaining the bent state BS of the leg as shown in FIG. 4C.

Figure 4D:
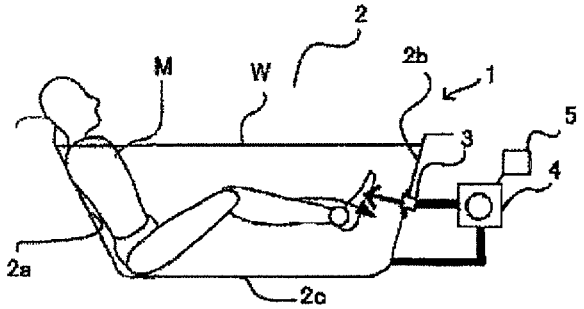

Next, in the process (iv) of FIGS. 3A and 3B, the jetting flow rate Q jetted from the jetting unit 3 is decreased to a value lower than the prescribed jet flow value Qb. At this time, the force pressing the sole m2 decreases. Hence, as shown in FIG. 4D, the posture of the bather M is gradually shifted from the bent state BS of the leg joints (ankle joint, knee joint, and hip joint) toward the relatively stretched state SS. That is, the posture of the bather M is placed in the state of the foot being moved toward the second bathtub wall surface 2*b*.

Figure 4E:
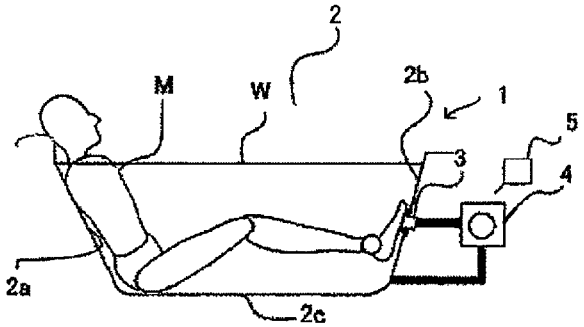

Next, in the process (v) of FIGS. 3A and 3B, the jetting flow rate Q jetted from the jetting unit 3 becomes a value QS lower than the prescribed jet flow value Qb, i.e., a value of not bending the leg. That is, no force pressing the leg is applied from the jetting unit 3 to the sole m2, or a force of not bending the leg of the bather M is applied to the sole m2. At this time, the bather M assumes a posture of retaining the stretched state SS of the leg as shown in FIG. 4E. This jet flow state is similar to the jet flow state shown in the process (i) of FIGS. 3A and 3B. The posture of the bather M at this time is similar to the bent/stretched state shown in FIG. 4A. Furthermore, the jet flow state shown in the process (vi) of FIGS. 3A and 3B is similar to that of the process (ii) of FIGS. 3A and 3B. The leg of the bather M is also in the state shown in FIG. 4B.

The aforementioned motion illustrated in the processes (i) to (vi) of FIGS. 3A and 3B and FIGS. 4A to 4E is repeated. Thus, the bather M can exercise by the jet flow without having the will of positively exercising by oneself during bathing. The exercise effect in this exercise includes the action on muscles by the bending and stretching motion of the leg, and the action of minutely adjusting the leg while receiving water flow. In addition, the exercise is done in the environment in which heat of hot water is applied. Thus, effective exercise can be done even in a short time. Furthermore, by exercising after the flexibility of muscles, tendons, and joints is increased, the bather can undergo safe and effective exercise. Thus, this embodiment can also be used for injury rehabilitation, for instance.

Hence, by increasing and decreasing the jetting flow rate Q from the jetting unit 3 under the control of the controller 5, the foot of the bather M reciprocates along the longitudinal direction of the bathtub 2. As a result, the leg of the bather M can be subjected to bending/stretching exercise. Furthermore, the leg is bent and stretched by the jet flow. This does not necessarily need a strong will of the bather M to exercise. Hence, the bather M can be caused to exercise continually. Furthermore, the jetting unit 3 is provided in the second bathtub wall surface 2*b*. When the jet flow is not jetted, the bathtub can be used like a normal bathtub. Thus, the jetting unit 3 can save time and effort for additionally attaching or detaching an exercise machine, and is unobtrusive. That is, it can be said that the bathtub device 1 according to the embodiment of the invention is an exercise bathtub device capable of causing a bather M to passively do bending/stretching exercise while allowing the bather M in the sitting state.

Furthermore, when the leg is stretched with the decrease of the jetting flow rate Q, the weakening jet flow guides the foot of the bather M to the vicinity of the jetting unit 3 like priming water. Hence, the bather M does not need to consciously adjust the leg.

Figure 5A:
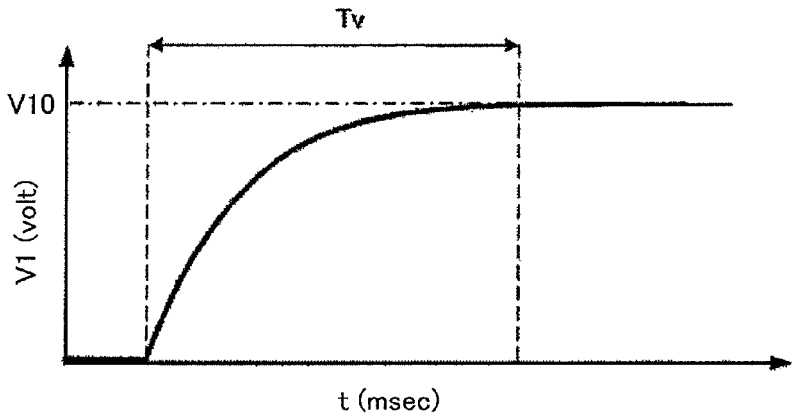
FIGS. 5A and 5B illustrate the driving state of a jetting driving unit according to the embodiment of the invention and the jetting flow rate thereof.
Figure 5B:
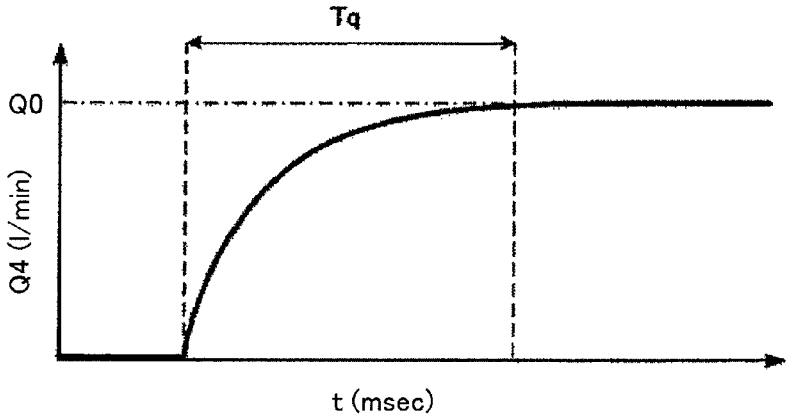

FIGS. 5A and 5B are graphs illustrating the driving state of the jetting driving unit included in the bathtub device 1 according to this embodiment, and the jetting flow rate jetted by the jetting driving unit. Here, the amount of water adjusted by the jetting driving unit 4 and supplied to the jetting unit 3 is equal to the amount of water (jetting flow rate Q) jetted by the jetting unit 3. Hence, the jetting flow rate Q4 supplied to the jetting unit 3 by the jetting driving unit 4 is described.

As shown in FIG. 5A, the application voltage V1 applied to the jetting driving unit 4 by the controller 5 increases from an initial value to a target application voltage V10 in a voltage rise time Tv. Then, under the application voltage V1 from the controller 5, the jetting flow rate Q4 supplied from the jetting driving unit 4 to the jetting unit 3 is varied by the jetting driving unit 4 from an initial jetting flow rate to a target jetting flow rate Q0 in a jetting flow rate rise time Tq. The jetting flow rate rise time Tq varied to the target jetting flow rate Q0 at this time is sufficiently short. For instance, the application voltage V1 applied to the jetting driving unit 4 by the controller 5 rises to the target application voltage V10 in a voltage rise time Tv of 180 milliseconds as shown in FIG. 5A. In this case, the jetting driving unit 4 can vary the jetting flow rate Q4 to the target jetting flow rate Q0 in a jetting flow rate rise time Tq of 150 milliseconds (FIG. 5B).

Thus, in the jetting driving unit 4, the jetting flow rate rise time Tq to the target jetting flow rate Q0 is sufficiently short. The jetting state which can be realized by using this jetting driving unit 4 is described with reference to FIGS. 6A to 6D. FIGS. 6A to 6D are graphs illustrating the jetting state. The vertical axis represents the jetting flow rate Q4 supplied from the jetting driving unit 4 to the jetting unit 3 (i.e., jetting flow rate Q jetted from the jetting unit 3). The horizontal axis represents time t.

The jetting driving unit 4 can instantaneously raise the jetting flow rate Q4 to the target jetting flow rate Q0. Hence, the jetting driving unit 4 can output a jetting flow rate Q4 varying like a sawtooth wave or triangular wave shown in FIG. 6A.

Furthermore, as shown in FIGS. 6B and 6C, the jetting driving unit 4 can output a jetting flow rate Q4 varying like a fast rising trapezoidal wave, a rectangular wave, or a slow rising trapezoidal wave. Moreover, as shown in FIG. 6D, the jetting driving unit 4 can output a jetting flow rate Q4 varying like a sine wave (or cosine wave). Here, the initial jetting flow rate Qi of the jetting flow rate Q4 can be made higher than 0 liters/min. This can achieve a shorter rise time, and makes it possible to instantaneously output a jetting flow rate Q4 pursuant to the signal (command) of the controller 5.

For instance, the application voltage V1 supplied from the controller 5 can be raised from 0 volts to 120 volts in approximately 180 milliseconds. Then, the jetting flow rate Q4 supplied to the jetting unit 3 by the jetting driving unit 4 is increased from 0 liters/min to 140 liters/min in approximately 150 milliseconds. Furthermore, to further shorten the rise time of the jetting flow rate Q4, for instance, the application voltage V1 supplied from the controller 5 can be controlled so as to rise from an offset state such as 30 volts to 120 volts in approximately 150 milliseconds. Then, the jetting flow rate Q4 supplied to the jetting unit 3 by the jetting driving unit 4 can be increased from 35 liters/min to 140 liters/min in 120 milliseconds.

Second Embodiment

Next, a second embodiment is described with reference to FIG. 7.

FIG. 7 is a schematic cross-sectional view illustrating a bathtub device according to the embodiment of the invention.

As shown in FIG. 7, in the second bathtub wall surface 2*b* of the bathtub 2, a first jetting unit 3L for the left leg and a second jetting unit 3R for the right leg (hereinafter also collectively referred to as "jetting unit 3") are provided. The first jetting unit 3L for the left leg and the second jetting unit 3R for the right leg are connected to a first jetting driving unit 4L and a second jetting driving unit 4R (hereinafter also collectively referred to as "jetting driving unit 4"). The first jetting driving unit 4L and the second jetting driving unit 4R can alternately jet a jet flow to both legs including the soles m2 of the bather M. The direction of the jet flow squirted from the jetting unit 3 is directed from the second bathtub wall surface 2*b* to the first bathtub wall surface 2*a*. The pair of these jetting units 3 is horizontally arranged. For instance, the jetting units 3 are located at positions symmetric with respect to a center line vertically extending on the second bathtub wall surface 2*b*.

In FIG. 7, for convenience of illustration, the first and second jetting units 3L and 3R, and the jetting driving units 4L and 4R are depicted with a mutual displacement. However, in reality, the first jetting unit 3L located so as to be able to face the left sole and the second jetting unit 3R located so as to be able to face the right sole are located at the same height. This also applies to other sectional views described later.

The bathtub device 1*a* includes a first jetting driving unit 4L and a second jetting driving unit 4R for generating a jet flow. The jetting driving units 4L and 4R send a jet flow to the first jetting unit 3L and the second jetting unit 3R respectively connected thereto. The suction port 4*s* of the jetting driving unit 4 communicates into the bathtub 2. Thus, the jetting driving unit 4 pumps water from inside the bathtub 2 to generate a jet flow.

Furthermore, the first jetting driving unit 4 and the second jetting driving unit 4R adjust the jetting flow rate jetted from the first jetting unit 3L and the second jetting unit 3R. Here, when the first jetting unit 3L is in the "process of decreasing the jet flow", the second jetting unit 3R is adjusted to be in the state of the prescribed jet flow value Qb or more, i.e., in the "process of increasing the jet flow". The jetting flow rate adjusted by the jetting driving unit 4 is controlled by the signal of the controller 5 connected to the jetting driving unit 4.

Next, the operation of this embodiment is described with reference to FIG. 7 to FIG. 10D.

As shown in FIG. 7, with water (hot water) W stored in the bathtub 2, a bather M gets in the bathtub 2 and assumes a bathing posture. More specifically, the bather M brings the buttocks into contact with the bottom surface 2*c* of the bathtub 2, abuts the back m1 on the first bathtub wall surface 2*a* of the bathtub 2, and opposes the soles m2 to the second bathtub wall surface 2*b*. Then, the bather M places the soles m2 so as to cover the first and second jetting units 3L and 3R with both soles m2. Thus, the bather M assumes an initial posture to catch the jet flow jetted from the jetting unit 3 with the soles m2.

At this time, the bather M is in a relaxed state. However, in order that the body of the bather M may not be submerged in the water (hot water) W by the action of buoyancy, the bather M withstands the buoyancy by the legs (soles m2), buttocks, and trunk (back m1). This causes the muscle group around each support point to perform minute muscle activities. However, the activities of these muscle groups are minute and performed unconsciously. Hence, the bather M can easily retain the aforementioned bathing posture as in usual bathing. Furthermore, the action of buoyancy applied to the bather M oneself disturbs the balance of the bathing posture. In response, the bather M performs a compensating motion for unconsciously exerting the muscles throughout the body to stabilize the posture. At this time, muscle activities occur in a wide range of the body.

FIG. 8 is a schematic plan view illustrating the operation of the bathtub device 1*a* according to this embodiment. FIG. 8 shows the case where a jet flow is squirted alternately between left and right from the first jetting unit 3L located so as to be able to face the left sole and the second jetting unit 3R located so as to be able to face the right sole.

First, the jetting driving unit 4 and the controller 5 are activated. Thus, the jetting driving unit 4 pumps water in the bathtub 2 from the suction port 4*s* to generate a jet flow. Then, the jetting flow rate of the jet flow generated by the jetting driving unit 4 is adjusted by the jetting driving unit 4 upon receiving the signal (command) from the controller 5.

Upon receiving the signal (command) from the controller 5, the first jetting driving unit 4 and the second jetting driving unit 4R adjust the jetting flow rate of jetting water squirted alternately from the first jetting unit 3L and the second jetting unit 3R. For instance, the jetting flow rate increases in approximately 0.3 seconds from an initial jetting flow rate of 0 liters/min to a target jetting flow rate of e.g. 135 liters/min.

However, in the case of requiring higher responsivity, the initial jetting flow rate is preferably made higher than 0 liters/min. For instance, the initial jetting flow rate is set to 30 liters/min so that the foot is not separated from the second bathtub wall surface 2*b*.

Next, the operating state of left-right alternate jetting from the first and second jetting units 3L and 3R is described.

In the operating state T21, the first jetting unit 3L jets water at a jetting flow rate of a prescribed value Qa or more.

Then, in the operating state T22, the jetting flow rate jetted from the first jetting unit 3L is in a jetting state Qdown in which the jetting flow rate is decreased from the value of the prescribed value Qa or more toward the state of not bending the leg.

In the operating state T23, the jetting flow rate jetted from the first jetting unit 3L is a jetting flow rate of not bending the leg.

Then, in the operating state T24, the jetting flow rate jetted from the first jetting unit 3L is in a state Qup in which the jetting flow rate is increased from the jetting flow rate of not bending the leg toward the jetting flow rate of the prescribed value Qa or more.

On the other hand, the second jetting unit 3R is operated as follows. In the operating state T21, the jetting flow rate jetted from the second jetting unit 3R is a jetting flow rate of not bending the leg.

Next, in the operating state T22, the jetting flow rate jetted from the second jetting unit 3R is in a state Qup in which the jetting flow rate is increased from the jetting flow rate of not bending the leg to the prescribed value Qa or more.

Then, in the operating state T23, the jetting flow rate jetted from the second jetting unit 3R is in the state of jetting water at the prescribed value Qa or more.

Then, in the operating state T24, the jetting flow rate jetted from the second jetting unit 3R is in a jetting state Qdown in which the jetting flow rate is decreased from the value of the prescribed value Qa or more toward the jetting flow rate of not bending the leg.

The operating states T21, T22, T23, and T24 are shifted in this order. After the operating state T24, the state returns to the operating state T21. Thus, the operating states T21, T22, T23, and T24 can be repeated cyclically.

Here, the prescribed value Qa refers to a jetting flow rate enough to maintain the bent state BS of the leg of the bather M.

Next, the states of the leg of the bather M derived from the aforementioned jetting states are described.

In the operating state T21, when the first jetting unit 3L jets water at the prescribed value Qa or more, the ankle joint, knee joint, and hip joint of the left leg of the bather M are in the bent state BS. The left foot is separated from the second bathtub wall surface 2*b*.

Next, in the operating state T22, the jetting flow rate jetted from the first jetting unit 3L is in the jetting state Qdown of decreasing toward a value lower than the prescribed value Qa. The ankle joint, knee joint, and hip joint of the left leg of the bather M are shifted from the bent state BS to the relatively stretched state SS.

In the operating state T23, the jetting flow rate jetted from the first jetting unit 3L is in the state of not bending the leg. At this time, the ankle joint, knee joint, and hip joint of the left leg of the bather M are in the relatively stretched state SS.

Then, in the operating state T24, the first jetting unit 3L jets water in the state Qup of increasing the jetting flow rate. At this time, the ankle joint, knee joint, and hip joint of the left leg of the bather M are shifted from the relatively stretched state SS toward the bent state BS.

FIGS. 9A to 9D show the relationship between the jetting flow rate of the bathtub device according to the embodiment of the invention and the state of the leg of the bather.

More specifically, FIG. 9A to FIG. 9D are graphs illustrating the jetting flow rate in the bathtub device 1*a* according to this embodiment, with time taken on the horizontal axis. The vertical axis of FIG. 9A represents the jetting flow rate QL jetted from the first jetting unit 3L. The vertical axis of FIG. 9B represents the jetting flow rate QR jetted from the second jetting unit 3R. The vertical axis of FIG. 9C represents the bent/stretched state LSL of the left leg of the bather M. The vertical axis of FIG. 9D represents the bent/stretched state LSR of the right leg of the bather M. The horizontal axis of FIG. 9A to FIG. 9D represents time t.

The temporal variation of the jetting state (jetting flow rate QL, QR) is described with reference to FIGS. 9A and 9B.

In the operating state T21, the jetting flow rate QL jetted from the first jetting unit 3L is a prescribed value Qa or more. The jetting flow rate QR jetted from the second jetting unit 3R is in the jet flow state of not bending the leg (less than a prescribed jet flow value Qb).

Next, in the operating state T22, the jetting flow rate QL jetted from the first jetting unit 3L is decreased from the value of the prescribed value Qa or more. In this process, the jetting flow rate QR jetted from the second jetting unit 3R is increased so that the jetting flow rate QR jetted from the second jetting unit 3R becomes the prescribed jet flow value Qb or more.

Here, the prescribed jet flow value Qb is described. If a jetting flow rate exceeding the prescribed jet flow value Qb is jetted to the sole m2 of the bather M, the foot is separated from the second bathtub wall surface 2*b* and the jetting unit 3. The leg of the bather M is shifted from the relatively stretched state SS toward the bent state BS. On the other hand, if the jetting flow rate turns from a value higher than the prescribed jet flow value Qb to a value lower than the prescribed jet flow value Qb, the leg of the bather M turns from the bent state BS to the relatively stretched state SS. That is, the foot is placed in the state of moving toward the second bathtub wall surface 2*b*.

Here, the prescribed value Qa of the jetting flow rate jetted from the jetting unit 3 is preferably e.g. 110 liters/min or more. For jetting to alternately move the legs more intensively in synchronization, the prescribed value Qa is preferably set to 150 liters/min, and more preferably 180 liters/min.

The prescribed jet flow value Qb is set to 50 liters/min, preferably 80 liters/min, and more preferably 90 liters/min.

Next, in the operating state T23, the jetting flow rate QL jetted from the first jetting unit 3L is in the state of not bending the leg (less than the prescribed jet flow value Qb). The jetting flow rate QR jetted from the second jetting unit 3R is the prescribed value Qa or more.

Next, in the operating state T24, the jetting flow rate QR jetted from the second jetting unit 3R is decreased from the value of the prescribed value Qa or more. In this process, the jetting flow rate QL is increased so that the jetting flow rate QL jetted from the first jetting unit 3L is the prescribed jet flow value Qb or more.

Thus, the controller 5 controls the first jetting driving unit 4L and the second jetting driving unit 4R so that in the process of decreasing the amount of jet flow (amount per unit time) jetted from one jetting unit (e.g., first jetting unit 3L), the amount of jet flow (amount per unit time) jetted from the other jetting unit (e.g., second jetting unit 3R) is increased to the prescribed jet flow value Qb or more.

This control of the controller 5 is alternately performed on the first jetting driving unit 4L and the second jetting driving unit 4R.

In this example, the bent state BS of the leg with one foot sufficiently separated from the jetting unit 3 turns to the stretched state SS of the leg with the sole m2 abutting the jetting unit 3. During this process, jetting is controlled to reach the prescribed jet flow value Qb or more at which the other foot is separated from the jetting unit 3. That is, the jetting flow rate (jetting flow rate QL and jetting flow rate QR) jetted from the jetting unit 3 is controlled so as to create a state (hereinafter also referred to as overlap) of both feet being separated from the jetting unit 3. Such control can create an exercising state closer to the actual gait motion.

Thus, in bending and stretching the left and right legs of the bather M, the controller 5 controls the first jetting driving unit 4L and the second jetting driving unit 4R so that the state of the left and right feet includes the state of the left and right feet being simultaneously separated from the first jetting unit 3L and the second jetting unit 3R.

In this example, in the operating state T22 and operating state T24, the intervals of the jet flow jetted from the first jetting unit 3L and the second jetting unit 3R are controlled so as not to be symmetric. More specifically, in the operating state T22, the absolute value of the rate of change with respect to time of the jetting flow rate QL jetted from the first jetting unit 3L is different from the absolute value of the rate of change with respect to time of the jetting flow rate QR jetted from the second jetting unit 3R. This is because, while a jetting flow rate of the prescribed jet flow value Qb or more is required to bend the leg of the bather M, the jetting flow rate at which the leg starts to stretch is lower than the prescribed value Qa. That is, for a jetting flow rate of the prescribed jet flow value Qb or less, the leg of the bather M retains the stretched state SS.

In actual gait, in the stretched state, only the repulsive force from the ground is applied to the leg, and the pressing force to the leg is weak. Thus, in this example, jetting water to the stretched leg is made less than the prescribed jet flow value Qb to create a state close to actual walking (gait). This control can cause the user (bather M) to do an underwater walking motion closer to gait motion even in a sitting posture while keeping the feeling of exercise experienced by the bather M.

Next, the leg bending/stretching exercise of the bather M caused by variation of the jetting flow rate is described with reference to FIG. 9A to FIG. 10D.

In the operating state T21, the first jetting unit 3L is in the state of jetting water at a jetting flow rate QL of the prescribed value Qa or more. The jetting flow rate QR jetted from the second jetting unit 3R is in the state of not bending the leg. At this time, the bather M receives the pressing force from the jet flow at the left sole. The ankle joint, knee joint, and hip joint of the left leg are in the bent state BS. On the other hand, no pressing force, or a force of not bending the leg of the bather M, is applied to the right sole. Hence, the ankle joint, knee joint, and hip joint of the right leg are in the relatively stretched state SS, and the bather M assumes a posture shown in FIG. 10A.

Next, in the operating state T22, the jetting flow rate QL jetted from the first jetting unit 3L is decreased from the jetting flow rate of the prescribed value Qa or more. In this process, as shown in FIGS. 9A and 9B, at time t11 before the jetting flow rate QL jetted from the first jetting unit 3L becomes lower than the prescribed jet flow value Qb, the jetting flow rate QR jetted from the second jetting unit 3R is controlled to become the prescribed jet flow value Qb or more.

Figure 10A:
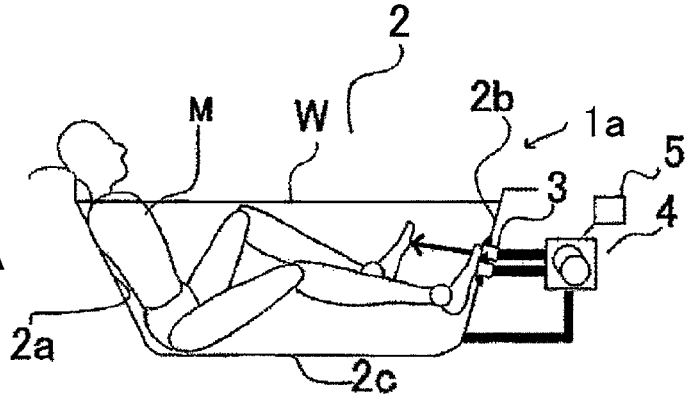
FIGS. 10A to 10D illustrate states of a bather in the bathtub device according to the embodiment of the invention
Figure 10B:
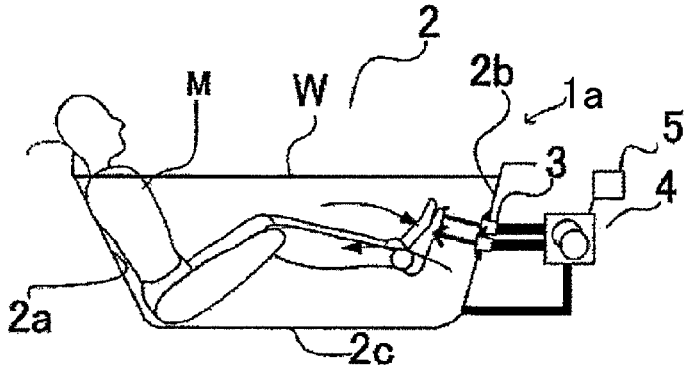

At this time, the force pressing the left sole of the bather M is weakened with the decrease of the jetting flow rate. Hence, as shown in FIG. 10B, the ankle joint, knee joint, and hip joint of the left leg are naturally stretched, and the left foot is in the state of moving toward the second bathtub wall surface 2*b*. The ankle joint, knee joint, and hip joint of the right leg are gradually shifted from the relatively stretched state SS to the bent state BS. That is, the overlap state occurs in which both soles are separated from the jetting unit 3.

Here, the phase of the stretching leg of the bather M can be matched with the phase of the bending leg. That is, the bending/stretching motion can be caused simultaneously and alternately. In this case, preferably, at the same time as the jetting flow rate from one jetting unit falls below the prescribed value Qa, the jetting flow rate from the other jetting unit is set to the prescribed jet flow value Qb.

Figure 10C:
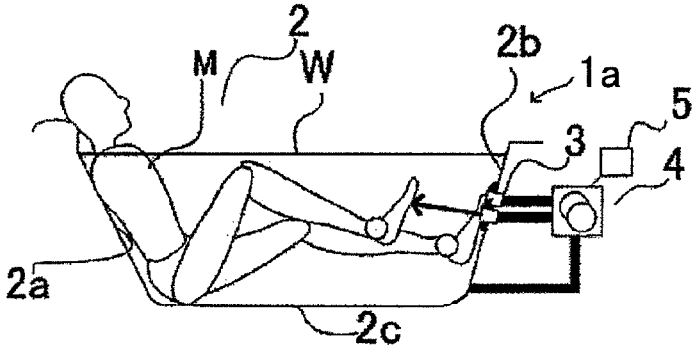

Then, in the operating state T23, the jetting flow rate QR jetted from the second jetting unit 3R can be the prescribed value Qa or more. In this case, as shown in FIG. 10C, the leg of the bather M retains the bent state BS. At this time, the first jetting unit 3L jets water at a jetting flow rate QL lower than the prescribed jet flow value Qb. At this time, the ankle joint, knee joint, and hip joint of the left leg of the bather M are in the stretched state SS. The ankle joint, knee joint, and hip joint of the right leg are in the bent state BS.

In the operating state T24, the jetting flow rate QR jetted from the second jetting unit 3R is decreased toward a value lower than the prescribed value Qa. In this process, the jetting flow rate QL jetted from the first jetting unit 3L is controlled to become the prescribed jet flow value Qb or more. At this time, until time t12 at which the jetting flow rate QL jetted from the first jetting unit 3L exceeds the prescribed jet flow value Qb, the jetting flow rate QR jetted from the second jetting unit 3R is kept at the prescribed jet flow value Qb or more. That is, at time t13 subsequent to time t12, the jetting flow rate QR becomes lower than the prescribed jet flow value Qb. At this time, the ankle joint, knee joint, and hip joint of the right leg of the bather M are shifted from the bent state BS toward the relatively stretched state SS. The ankle joint, knee joint, and hip joint of the left leg are gradually shifted from the relatively stretched state SS to the bent state BS.

At this time, with the increase of the amount of jet flow pressing the left sole, the ankle joint, knee joint, and hip joint of the left leg of the bather M are shifted from the relatively stretched state SS to the bent state BS. On the other hand, the force pressing the right sole is weakened with the decrease of the jetting flow rate QR. Hence, the ankle joint, knee joint, and hip joint of the right leg of the bather M are naturally stretched and shifted from the bent state BS toward the relatively stretched state SS. That is, the right leg moves toward the second bathtub wall surface 2*b*. In other words, the posture of the bather M is in the overlap state shown in FIG. 10D in which both soles are separated from the jetting unit.

After the overlap state in the operating state T24, the jetting state in the operating state T24 becomes similar to that in the operating state T21. In this example, the operating states T21 to T24 constitute one cycle of the leg motion. For instance, the total time of the operating states T1 to T4 can be set to 1 to 2 seconds. This can make the motion close to walking motion and realize many leg bending/stretching exercises. Thus, effective exercise can be achieved. On the other hand, the total time of the operating states T21 to T24 can be set to approximately 3 to 6 seconds. This lengthens the time in which the jet flow is received by the soles m2. That is, the time of the overlap state is lengthened. Hence, both feet remain in the hot water space separated from the second bathtub wall surface 2*b*. That is, by lengthening the overlap time of the bending/stretching exercise, the time of an unstable posture can be lengthened. By incorporating the task of retaining an unstable posture into exercise, muscle groups required for balance performance can be trained.

Figure 10D:
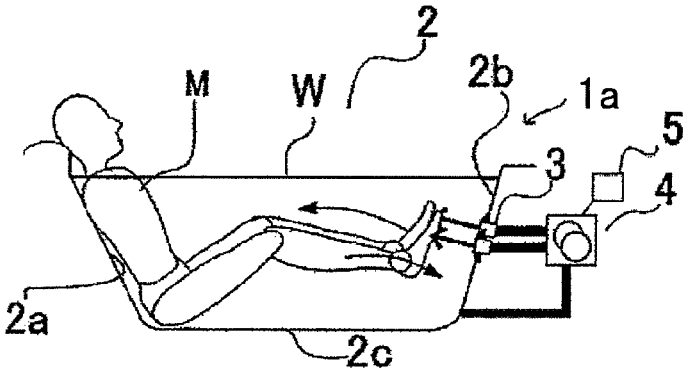

The aforementioned jetting states are repeated in the left and right jetting units (first jetting unit 3L and second jetting unit 3R). Thus, by the jet flow jetted alternately from the first jetting unit 3L and the second jetting unit 3R, the bather M does exercise of alternately bending and stretching the left and right legs. The alternate bending/stretching exercise of the left and right legs can be described by repeating FIGS. 10A to 10D. To make the alternate bending/stretching exercise of the left and right legs closer to the actual walking motion, the overlap state of FIGS. 10B and 10D is important in which the left and right legs simultaneously move.

Furthermore, the jet flow producing the bent state BS generates a flow field of water enclosing the leg. Hence, a force of preventing the leg from deviating from the jet flow acts on the leg. A phenomenon similar to this can be observed when a table tennis ball is put on water from a fountain. The table tennis ball stays at the center of the jet flow. By such a jet flow, the bather M can efficiently do the bending/stretching exercise of the leg.

Hence, by the jet flow jetted alternately by the first jetting unit 3L and the second jetting unit 3R, the left and right feet of the bather M alternately reciprocate along the longitudinal direction of the bathtub 2. As a result, the left and right legs of the bather M can be subjected to alternate bending/stretching exercise. Furthermore, the leg is bent and stretched by the jet flow. This does not necessarily need a strong will of the bather M to exercise. Hence, the bather M can be caused to exercise continually. Furthermore, the jetting unit 3 is provided in the second bathtub wall surface 2*b*. When the jet flow is not jetted, the bathtub can be used like a normal bathtub. Thus, the jetting unit 3 can save time and effort for additionally attaching or detaching an exercise machine, and is unobtrusive. That is, it can be said that the bathtub device 1*a* according to the embodiment of the invention is an exercise bathtub device capable of causing a bather M to do passive exercise of underwater walking imitating gait while allowing the bather M in the sitting state.

By using the driving device (jetting driving unit 4) as shown in FIGS. 6A to 6D, the amount of water jetted from the jetting unit 3 can be controlled with good responsivity based on the signal (command) from the controller 5. That is, the forward swing state of the left and right feet required for the walking motion on land can be realized by jetting water. For instance, the walking motion on land includes the stance phase and the swing phase. In the stance phase, the foot is in contact with the ground, and the sole is subjected to load. In the swing phase, the foot is swung forward and moves in the air, and the sole is not subjected to load. The ratio of the stance phase to the swing phase is 6 to 4, for instance. Hence, the state of jetting water and the state of not jetting water (including the jet flow state in which the jetting flow rate is the prescribed jet flow value Qb or less) in the jetting cycle are generated with the ratio of 6 to 4 during one cycle of alternate jetting to the left and right soles. Thus, the load stimulus received at the soles is made close to that of the walking motion on land. It is considered that this can effectively provide the bather with the load stimulus to the soles.

It has been confirmed by experiments on muscle activities that the state of the left and right feet in continual motion not only provides exercise of the legs but also has a ripple effect on full-body exercise.

FIG. 11 shows the muscle activity of muscle groups of a bather in the jetting state. The vertical axis of FIG. 11 represents the active state of each muscle group (the amount of muscle activity MA), and the horizontal axis represents time t.

As shown in FIG. 11, motions are observed in muscle groups of lower extremities such as the gastrocnemius muscle M1, the tibialis anterior muscle M5, and the hamstrings M4 (quadriceps femoris muscle M2). In addition, it is seen that back muscles such as erector spinae muscles M3, and arm muscles such as the forearm muscle group M6 (brachioradialis muscle) are active.

Thus, the bathtub device 1*a* according to the embodiment of the invention activates the muscle groups of not only the leg but also the full-body. Hence, the bathtub device 1*a* is effective for exercise and muscle training of not only the leg but also the full-body. Furthermore, it has also been found from subjective assessment that the feeling of exercise like walking motion is induced in the bather M.

With reference to FIGS. 12A and 12B, activities of muscles caused by passive bending/stretching exercise are specifically described. FIG. 12A illustrates muscle groups activated by passive exercise resulting from the jet flow, and shows the position of muscle groups shown in FIG. 12B. FIG. 12B shows that different muscles of the leg are activated depending on the jetting state, where the vertical axis represents the amount of muscle activity MA, and the horizontal axis represents time t. This figure shows the amount of muscle activity MA of the hamstrings M4 (biceps femoris muscle, etc.) and the tibialis anterior muscle M5.

After time S1 (similar to time t11 in FIG. 9D), with the bending of the leg, the tibialis anterior muscle M5 starts to positively work. This phenomenon means that the muscle is activated in the state of the foot being separated from the second bathtub wall surface 2*b* and moving toward the first bathtub wall surface 2*a*.

Next, at time S2 (similar to time t13 in FIG. 9D), the foot of the bather M moves toward the second bathtub wall surface 2*b* and abuts the jetting unit 3 and the second bathtub wall surface 2*b*. FIG. 12B shows that when the foot of the bather M is brought into contact with the second bathtub wall surface 2*b* at time S2, the hamstrings M4 are activated.

Thus, the bending/stretching exercise of the leg associated with the increase and decrease of the jet flow activates different muscle groups and thereby enhances the exercise effect.

The tibialis anterior muscle M5 shown in FIGS. 12A and 12B is a muscle located in the lower extremity in the body segments of a human. The tibialis anterior muscle M5 is known as a muscle acting to provide clearance between the ground and the foot in walking. Thus, the exercise of activating the tibialis anterior muscle M5 means an exercise contributing to fall prevention.

On the other hand, the hamstrings M4 shown in FIGS. 12A and 12B are a muscle group located in the thigh in the body segments of a human. The hamstrings M4 are a muscle group composed of the biceps femoris muscle, the semimembranosus muscle, the semitendinosus muscle, and the adductor magnus muscle. The biceps femoris muscle is known as a muscle acting primarily to generate a kick-out force and propulsive force in walking. Hence, the exercise stimulating the hamstrings M4 means an exercise capable of contributing to maintenance of walking speed and improvement of walking function.

The jetting flow rate jetted from the jetting unit 3 and bending the leg of the bather M is set so as to be able to simultaneously bend the ankle joint, knee joint, and hip joint of the bather M when the bather M abuts the back m1 on the first bathtub wall surface 2*a* and opposes the sole m2 to the jetting unit 3. For instance, the jetting flow rate is 80 to 300 liters/min. If the magnitude of the jet flow is less than 80 liters/min, the sole m2 of the bather M may not be separated from the jetting unit 3. If the magnitude of the jet flow exceeds 300 liters/min, water W may overflow the bathtub 2.

If the jetting flow rate exceeds 110 liters/min, the moving distance of the leg pressed by the jet flow reaches 140 mm or more. It has been confirmed that above this condition, the user (bather M) experiences the feeling of exercise from the bending/stretching motion by the jet flow. It has been confirmed from a survey of 35 test users that beyond 110 liters/min, the foot moves 140 mm or more by the jetting water, and the bather M experiences the feeling of exercise.

To achieve a more effective and higher exercise effect in bending/stretching exercise, it is preferable to exercise under a jet flow of approximately 150 liters/min. More preferably, it is effective to exercise under a jet flow of approximately 180 liters/min. Here, this magnitude of jet flow is considerably higher than the magnitude of jet flow squirted for massage in circulation type bathtubs for home use. In typical massage blows, the jetting flow rate jetted from one jetting port is approximately 20 liters/min. In massage blows with higher intensity, the jetting flow rate is at most approximately 40 liters/min.

As described above, by increasing the amount of jet flow, the force pressing the sole is increased, and the movable range of the bending/stretching motion is expanded. With this increase of jet flow, sense organs located in the sole and tendon organs located in the leg are stimulated more effectively. This can effectively promote functions serving for walking.

The temperature of water (hot water) W used in the bathtub can be room temperature. However, it is preferable to use water in the temperature range of 36 to 41° C. For instance, at 36 to 38° C., the temperature is close to body temperature, and the thermal load is low. In this case, the jetting flow rate is increased to increase the amount of rotation of the bending/stretching motion. Alternatively, the cycle of jetting water is shortened to increase the number of bending/stretching motions. Thus, the exercise intensity is increased, and the bather M can be caused to exercise effectively.

On the other hand, to do sufficient exercise in a relatively short time, the hot water temperature is set higher (e.g., 39 to 41° C.). By the synergistic effect of heat and exercise, energy consumption is caused in a shorter time than in hot water set to a lower temperature. Thus, the bather M can do effective exercise in a short time.

The thermal effect and the exercise effect are described with reference to FIG. 13.

Figure 13:
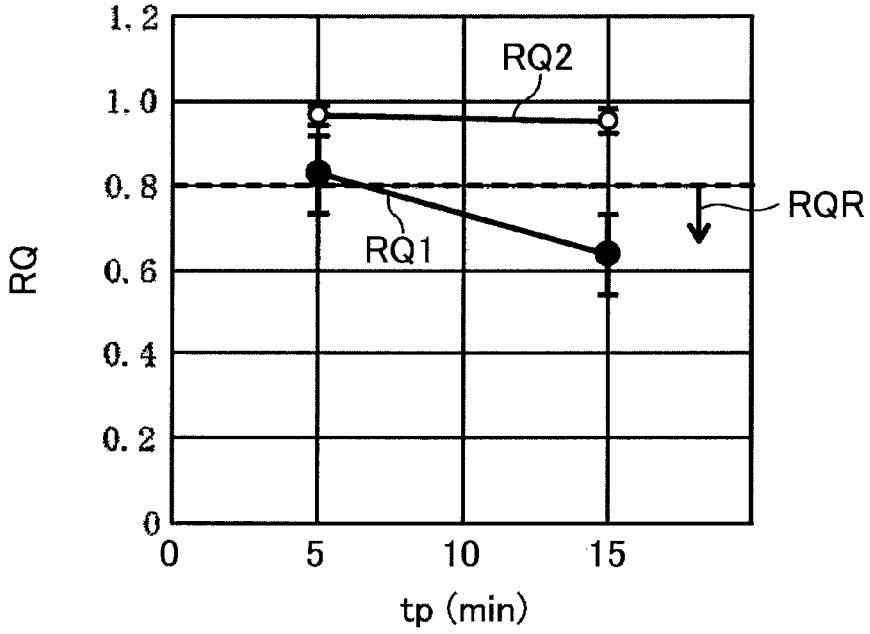
FIG. 13 shows respiratory quotients in use of the bathtub device according to the embodiment of the invention.

In FIG. 13, the vertical axis represents the respiratory quotient RQ indicating the fat burning efficiency, and the horizontal axis represents the elapsed time tp of exercise. More specifically, for comparison, FIG. 13 shows the respiratory quotient RQ1 for passive exercise with fast walking and jet flow, and the respiratory quotient RQ2 for fast walking as a comparative example. The respiratory quotient RQ refers to a value estimating the degree of fat burning, calculated as the ratio between the amount of oxygen taken in and the amount of carbon dioxide eliminated. A lower value of respiratory quotient RQ signifies a higher degree of fat burning. In the fat burning region RQR with low respiratory quotient RQ (e.g., 0.8 or less), the exercising state of fat burning (aerobic exercise) occurs.

As an experimental condition, in fast walking, the condition of walking on land at approximately 4.3 kilometers per hour was used. In bath walking using the bathtub device 1*a* according to the embodiment of the invention, the hot water temperature (temperature of water W) was set to 39° C., and the maximum jetting flow rate was set to approximately 160 liters/min.

Then, the respiratory quotient RQ1 of bath walking using the bathtub device 1*a* according to the embodiment of the invention enters the region with high fat burning effect (fat burning region RQR) earlier than the respiratory quotient RQ2 of walking on land. This result agrees with the fact that in typical walking on land, fat is not burned until walking is continued for approximately 40 to 50 minutes. Furthermore, the above result indicates that the bathtub device 1*a* according to the embodiment of the invention achieves a very high exercise effect in a short time by the synergistic effect of heat and exercise.

The effect of this embodiment is described.

As described above, according to this embodiment, the bather M can be caused to exercise without necessarily requiring a strong will to exercise. This exercise is a passive exercise applied externally. When assuming a bathing posture in a typical bathtub, the user (bather M) tries to retain the posture against buoyancy. Thus, in the bather M, minute muscle activities occur unconsciously. In the state of inducing these minute muscle activities, the bather M receives a jet flow alternately by the first and second jetting units 3L and 3R. As a result, the bather M can passively do underwater walking exercise by the jet flow even in a sitting posture. This can activate not only the leg muscle groups but also muscles located in the trunk supporting the legs.

Furthermore, actions of the jet flow jetted from the jetting unit 3 and the buoyancy applied to the bather M oneself disturb the balance of the bathing posture of the bather M. In response, the bather M performs a compensating motion for unconsciously exerting the muscles throughout the body to stabilize the posture. This can also cause full-body exercise. Thus, the bathtub device 1*a* according to the embodiment of the invention has little dependence on the will power of the bather M, and can provide an exercise easy to continue. Furthermore, this exercise can be done while in the bathing posture. Hence, it is easy to shift from normal bathing to exercise, which can be naturally done in the lifestyle. Thus, the effect of easily continuing exercise can also be expected. Furthermore, additional exercise machines are not needed to do exercise. Thus, when exercise is not done, the bathtub can be used like a normal bathtub, without time and effort for attaching or detaching an exercise machine. Hence, the bathtub device is easy to use.

Exercise using the embodiment of the invention was experienced by 35 users. Then, it was found that the underwater (bath) walking during bathing was naturally done in the bathing posture by jet flow. It was also found that the feeling of exercise and the feeling of using muscles were experienced by continuous underwater walking. It has been confirmed that after bathing, the users felt the effect of exercise, such as warmth in the legs and greater feeling of exercise than by jogging. Moreover, it was found from the users' experience that sweating is promoted within five minutes. According to the users' feedback, this exercise is also suitable for the dieting effect and serves to prevent metabolic syndrome.

Figure 15:
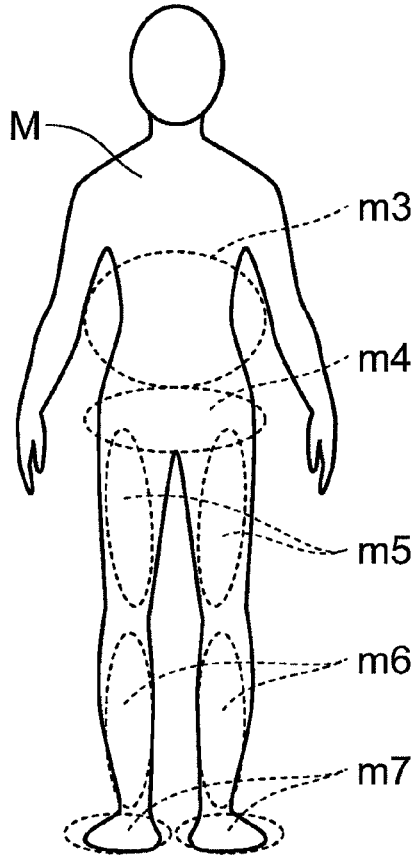
FIG. 15 shows sites of active muscles in the bathtub device according to the embodiment of the invention.

FIG. 15 shows sites in which the feeling of use (feeling of exercise) is experienced by bath walking. The difference of sites where the user (bather M) experiences the feeling of use results from the cycle of jetting water inducing walking motion during bathing and the duty ratio (the ratio between the jetting cycle and the time of the jet flow state at the jetting flow rate of bending the leg), and from the delay time of jetting water to the left and right soles. For instance, for a slow jetting cycle in the walking motion during bathing, the interval of receiving jet flow is lengthened. This activates muscles acting to stabilize the legs in the bathtub water against the jet flow in addition to muscles acting by the bending/stretching motion done under the jet flow. These two types of muscle activities can effectively train not only the muscle strength of exercise functions but also the muscle strength required for balance performance. This can provide the user with exercise for promoting balance performance in addition to exercise functions.

As a result, the user experiences the feeling of use in large muscle groups such as the abdomen/trunk muscle group m3 (erector spinae muscles, rectus abdominis muscle, abdominal oblique muscles, etc.), the thigh muscle group m5 (hamstrings, quadriceps femoris muscle, etc.), and the lower leg muscle group m6 (soleus muscle, tibialis anterior muscle, gastrocnemius muscle, etc.). In addition, the user experiences the feeling of use in muscle groups contributing to balance retention, including the hard-to-train inner muscles m4 (adductor magnus muscle, adductor longus muscle, and iliacus muscle), and the foot/sole muscle group m7 located in the sole (extensor digitorum brevis muscle, abductor hallucis muscle, flexor hallucis longus muscle, etc.).

Furthermore, in walking during bathing, by shortening the cycle of jetting water, a stable leg trajectory can be provided to the user. Thus, more bending/stretching exercises can be achieved in a short time. Thus, the user can effectively train the muscle groups m5 and m6 positively working in daily motions, such as the biceps femoris muscle, quadriceps muscle, soleus muscle, tibialis anterior muscle, and gastrocnemius muscle.

Furthermore, by receiving jet flow at the sole, the sense organs located in the sole can be stimulated. The sensitivity of sense organs (pressure receptors) located in the sole decreases with the increase of age. For this reason, as is commonly known, the elderly cannot sense the barycenter position of the body by the sole, which results in increasing the possibility of fall. However, according to recent research reports, the sensitivity of sense organs and the processing function of the nervous system transmitting the information detected by the sense organs can be maintained by continually stimulating the sense organs.

In the bathtub device of the embodiment of the invention, a jet flow strong enough to bend the leg is applied to the sole.

Thus, first, by bending and stretching the leg, the bathtub device stimulates proprioceptors such as tendon spindles and muscle spindles located in tendons and muscles. Second, by directly receiving the jet flow at the sole, the sense organs (pressure receptors) located in the sole are stimulated. This can provide facilitation between the sense organs and the nervous system path transmitting the information detected by the sense organs. Thus, balance performance can be improved.

Furthermore, according to this embodiment, a jet flow is jetted to the sole m2 of the bather M alternately between left and right from the first jetting unit 3L for the left leg and the second jetting unit 3R for the right leg. Hence, in addition to the bending/stretching exercise of the leg, the bather M undergoes a turning motion about the pelvis. As a result, in addition to the exercise effect to muscle groups around the legs, the exercise effect to the rectus abdominis muscle, abdominal oblique muscles, and back muscle groups has been confirmed. Thus, the above exercise done in the bath activates not only the legs but also a wide range of the body. Hence, the bather M can do effective exercise.

Furthermore, according to this embodiment, in both legs, the feeling of exercise experienced by bending/stretching exercise varies with the jetting flow rate jetted from the jetting unit (first and second jetting units 3L and 3R).

Figure 14:
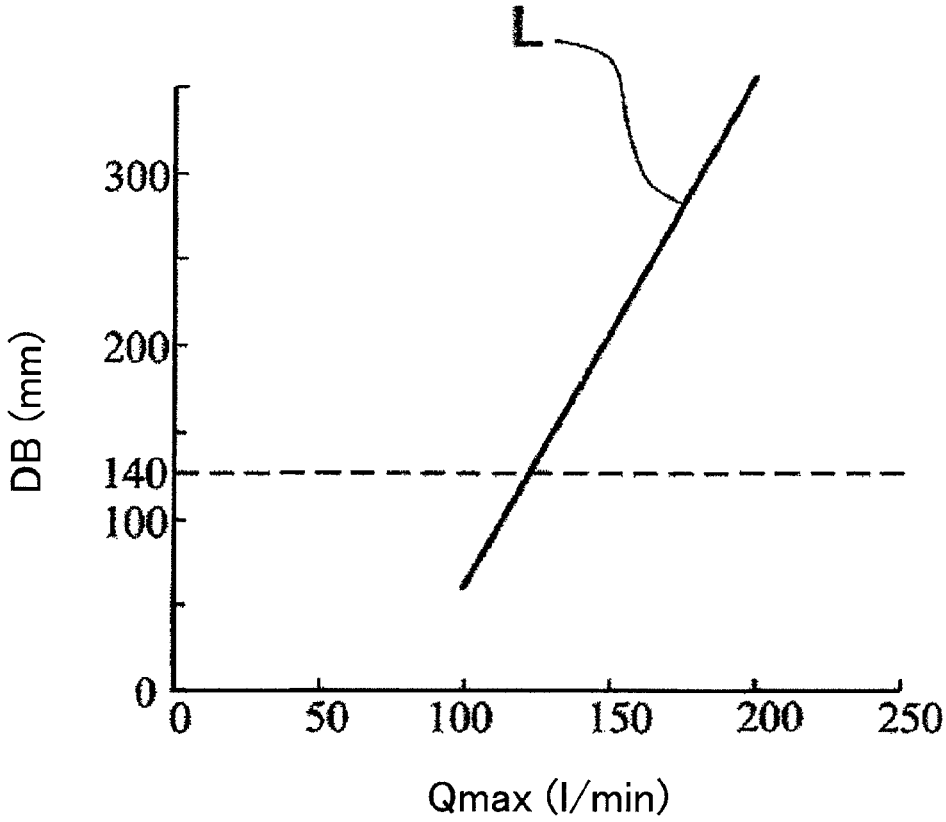
FIG. 14 shows the relationship between the jetting flow rate of the bathtub device according to the embodiment of the invention and the amount of foot movement.

FIG. 14 is a graph illustrating the experimental result on the relationship between the jetting flow rate of water jetted from the jetting unit 3 and the amount of foot movement of the bather. More specifically, in this figure, the horizontal axis represents the maximum jetting flow rate Qmax, and the vertical axis represents the amount of foot movement DB. The maximum jetting flow rate Qmax is e.g. the value QB illustrated in FIG. 3A, i.e., the value of the prescribed value Qa or more, corresponding to the jet flow state of bending the leg of the bather M.

Here, the amount of foot movement DB is the distance that the foot of the bather M moves away from the second bathtub wall surface 2*b* by the jet flow when the bather undergoes bending/stretching motion by the jet flow from the jetting unit 3. That is, the solid line L shown in FIG. 14 represents the relationship between the maximum jetting flow rate Qmax and the amount of foot movement DB that the foot moves away from the second bathtub wall surface by the jet flow when the bather M undergoes bending/stretching motion by the jet flow from the jetting unit 3.

As shown by the solid line L, there is a correlation between the amount of foot movement DB and the maximum jetting flow rate Qmax. With the increase of the maximum jetting flow rate Qmax, the amount of foot movement DB increases. The foot is separated from the second bathtub wall surface 2*b* when and after the maximum jetting flow rate Qmax reaches approximately 80 liters/min. When the maximum jetting flow rate Qmax is approximately 80 liters/min or more, the foot starts to move and allows bending/stretching exercise. In order for the bather M to do more effective exercise, the maximum jetting flow rate Qmax is preferably set to 110 liters/min or more.

In this example, the moving distance of the foot is approximately 140 mm. To achieve more effective exercise, the bather M can select e.g. 180 liters/min as the maximum jetting flow rate Qmax. To achieve still more effective exercise, the jetting flow rate can be adjusted so that the maximum jetting flow rate Qmax is e.g. 200 liters/min. In this case, it has been experimentally found that the moving distance of the foot is approximately 250 mm to 300 mm.

If the maximum jetting flow rate Qmax is 110 liters/min or more, the amount of foot movement DB is 140 mm or more by the pressure of the jet flow. It has been confirmed that under the condition that the maximum jetting flow rate Qmax is 110 liters/min or more and the amount of foot movement DB is 140 mm or more, the user (bather M) experiences the feeling of exercise from the bending/stretching motion by the jet flow. It has been confirmed from a survey of 35 test users that beyond 110 liters/min, the foot moves 140 mm or more by the jetting water, and the feeling of exercise is experienced. Here, with regard to the "feeling of exercise", major comments from the users report a light feeling of fatigue in the legs and a warm feeling in part of the muscles used.

In this specific example, with water (hot water) W stored in the bathtub 2, a bather M gets in the bathtub 2 and assumes a bathing posture. Then, for instance, by manipulating a manipulation button on the controller 5, the execution time of exercise and the cycle of bending/stretching exercise by the bathtub device 1*a* are arbitrarily set. Here, a plurality of exercise modes may be previously configured in the controller 5, and the bather M may select a desired exercise mode therefrom.

For instance, if the bather M selects a mode with high exercise load, the controller 5 controls the jetting driving unit 4 so as to repeat switching of the jetting flow rate between a state of high jetting flow rate and a state of low jetting flow rate at a relatively short cycle.

Here, the exercise time and exercise cycle may be automatically set by a timer. For instance, when the preset temperature of hot water is 39° C., the timer sets the exercise time of one set to 10 minutes.

Thus, in this specific example, exercise load can be arbitrarily set depending on the preference of the bather M. The configuration, operation, and effect of this specific example other than the foregoing are similar to those of the above embodiments.

The jetting driving unit 4 is based on e.g. a rotary pump. In this case, an impeller is rotated by a motor to suck water (hot water) W, thereby producing a jet flow jetted from the jetting unit 3. The jetting driving unit 4 is controlled by a sequencer, a timer, an AD/DA converter, and a computer. Thus, the driving state of the pump of the jetting driving unit 4 is controlled. The first jetting driving unit 4L and the second jetting driving unit 4R can each include an independent pump. Control by the controller 5 can be performed on these pumps.

The above description assumes that a rotary pump is used in the jetting driving unit 4. However, this example is not limited to the foregoing. For instance, the jetting driving unit 4 may be based on an electromagnetic reciprocating pump of the positive displacement type such as a plunger or piston to produce a jet flow jetted from the jetting unit 3.

Figure 16:
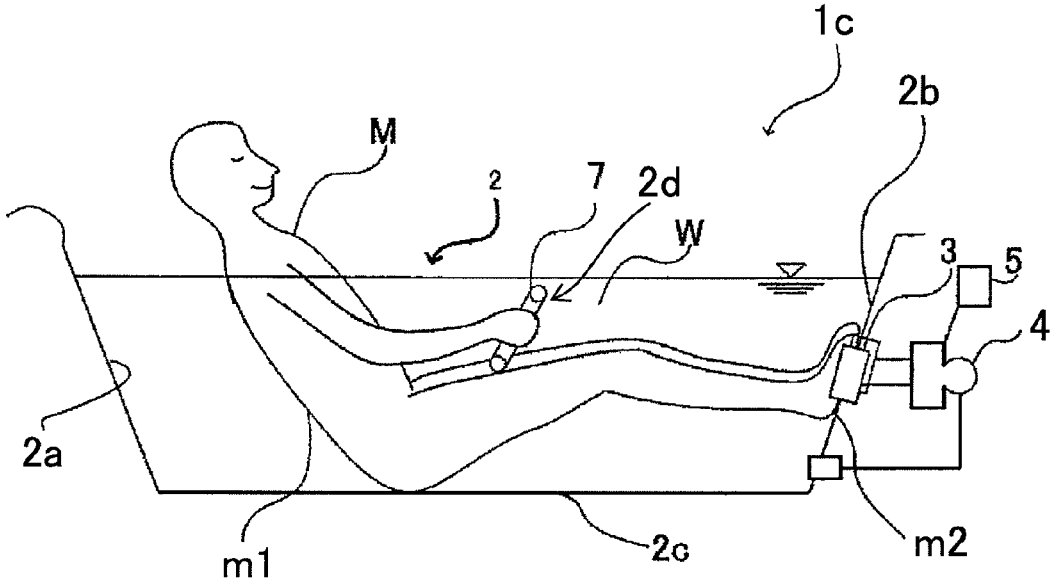
FIG. 16 is a schematic cross-sectional view illustrating a variation of the bathtub device according to the embodiment of the invention.

FIG. 16 is a schematic cross-sectional view illustrating a variation of the bathtub device according to this embodiment.

As shown in FIG. 16, the alternative bathtub device 1*c* according to this embodiment is different from the aforementioned bathtub device 1*a* in that a bathtub handrail 7 is provided on the bathtub sidewall surface 2*d* in contact with the bottom surface 2*c*. In FIG. 16, the first jetting driving unit 4L, the second jetting driving unit 4R, the first jetting unit 3L, and the second jetting unit 3R are omitted, and depicted as a jetting driving unit 4 and a jetting unit 3.

In this bathtub device 1*c*, by grasping the bathtub handrail 7, the bather M can retain a bathing posture in which the back m1 is not in contact with the first bathtub wall surface 2*a*. In this bathing posture, the bather M does underwater walking under the jet flow jetted from the jetting unit 3. Here, the force of the jet flow pressing the sole m2 transmits through the lower extremity to the upper extremity. That is, with the point of effort on the bathtub handrail 7, arm muscle groups in the forearm and upper arm are also activated against the force. Furthermore, abdomen muscle groups located between the lower extremity and the upper extremity are also activated. Hence, the bathtub device 1*c* enables full-body exercise.

Furthermore, even in the case where the bather M cannot lean the back m1 on the first bathtub wall surface 2*a*, the bather M can use the bathtub handrail 7 to do underwater walking by the jet flow jetted from the first and second jetting units 3L and 3R irrespective of the size of the bathtub 2.

The bathtub handrail 7 described above can be provided also in the bathtub device 1 described earlier, and achieves a similar effect.

Third Embodiment

Next, a third embodiment of the invention is described.

The configuration of the bathtub device 1*d* according to this embodiment can be made similar to that of the bathtub device 1*a* or the bathtub device 1*c* described above, and hence the description thereof is omitted.

Figure 17:
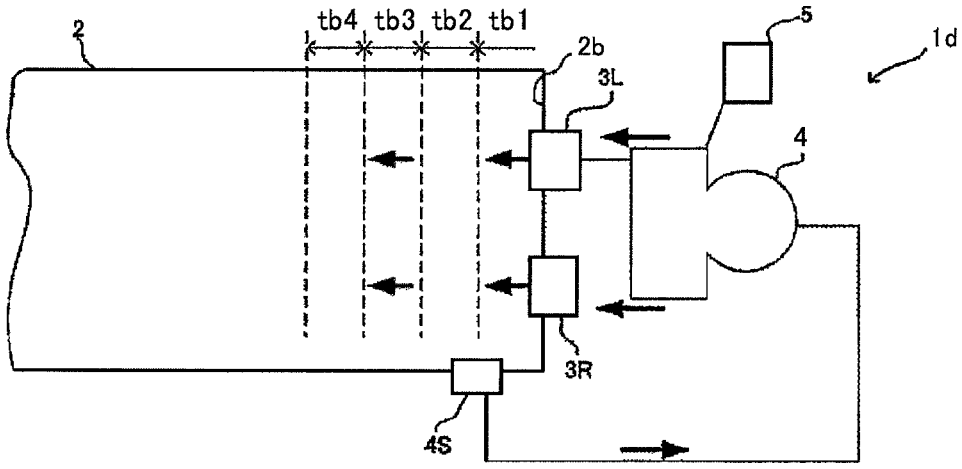
FIG. 17 is a schematic plan view illustrating the operation of a bathtub device according to the embodiment of the invention.

FIG. 17 is a schematic plan view illustrating the operation of the bathtub device according to this embodiment. More specifically, in the bathtub device 1*d* according to this embodiment, water flow is squirted simultaneously from the left jetting unit and the right jetting unit.

As shown in FIG. 17, in the bathtub device 1*d*, in contrast to the bathtub device 1*a*, the controller 5 controls the jetting driving unit 4 so that the jetting unit 3 can simultaneously jet water to the left and right soles. Thus, the left and right jetting units (first and second jetting units 3L and 3R) simultaneously jet water.

More specifically, in the operating state tb1 and operating state tb3, the first and second jetting units 3L and 3R simultaneously jet water. In the operating state tb2 and operating state tb4, the first and second jetting units 3L and 3R simultaneously do not jet water.

As a result, the bather M bends the ankle, knee, and hip joint when the jet flow is jetted to both legs. Furthermore, the bather M stretches the ankle, knee, and hip joint when the jet flow is not jetted. This bending/stretching exercise in both legs enables the bather M to continue comfortable exercise without being bored with the exercise. The configuration, operation, and effect of this embodiment other than the foregoing are similar to those of the above other embodiments.

Fourth Embodiment

Next, a fourth embodiment of the invention is described.

The configuration of the bathtub device 1*e* according to this embodiment can be made similar to that of the bathtub device 1*a* or the bathtub device 1*c* described above, and hence the description thereof is omitted.

Figure 18:
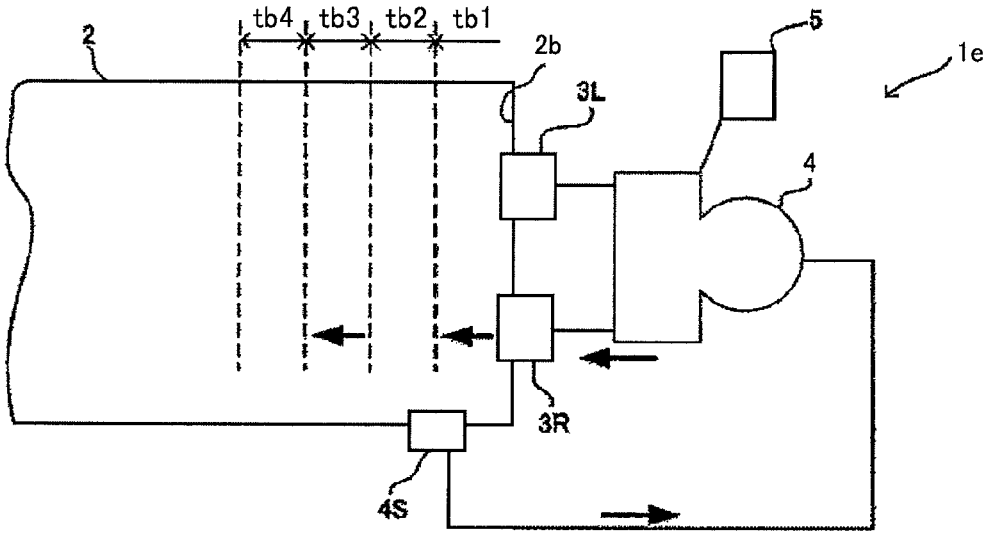
FIG. 18 is a schematic plan view illustrating the operation of a bathtub device according to the embodiment of the invention.

FIG. 18 is a schematic plan view illustrating the operation of the bathtub device according to this embodiment.

As shown in FIG. 18, the bathtub device 1*e* according to this embodiment squirts water flow from either one of the first jetting unit 3L and the second jetting unit 3R.

More specifically, in the operating state tb1 and operating state tb3, the second jetting unit 3R jets water. In the operating state tb2 and operating state tb4, neither of the first and second jetting units 3L and 3R jets water.

Thus, as in the bathtub devices 1*a*, 1*c*, 1*d*, and 1*e* according to the embodiments of the invention, the first jetting unit 3L and the second jetting unit 3R can perform at least one of the operations of alternately jetting water, simultaneously jetting water, and jetting water from either one of them. Thus, the bather M can be caused to do arbitrary exercise. For instance, any one of the left and right legs can be subjected to exercise.

The bending/stretching exercise of an arbitrary leg is applicable to e.g. rehabilitation therapy of one side of the body for brain disease. This can effectively cause bending/stretching exercise using the jet flow on the damaged side.

Furthermore, such exercise of an arbitrary leg not only prevents the bather M from being bored with the exercise, but also can cause the bather M to continue the exercise.

Fifth Embodiment

Next, a fifth embodiment of the invention is described.

The configuration of the bathtub device 1*f* (not shown) according to this embodiment can be made similar to that of e.g. the bathtub device 1*a* (or the bathtub device 1*c*) described above, and hence the description thereof is omitted. In the following, specific examples of the operation of the bathtub device according to this embodiment are described with reference to the drawings.

Figure 19A:
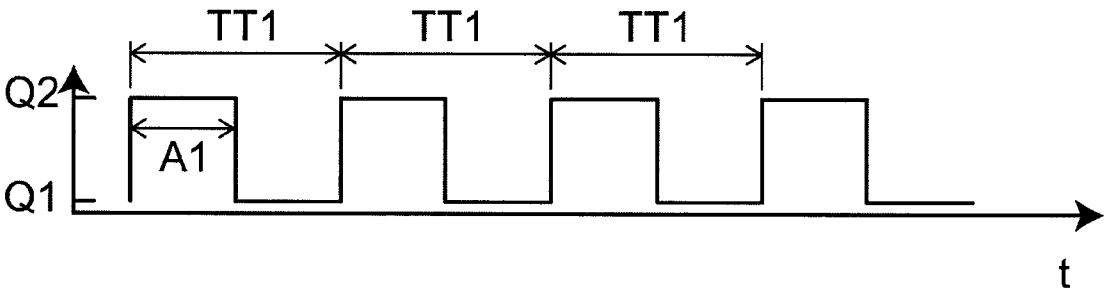
FIGS. 19A and 19B illustrate states of the jetting flow rate of the bathtub device according to the embodiment of the invention.
Figure 19B:
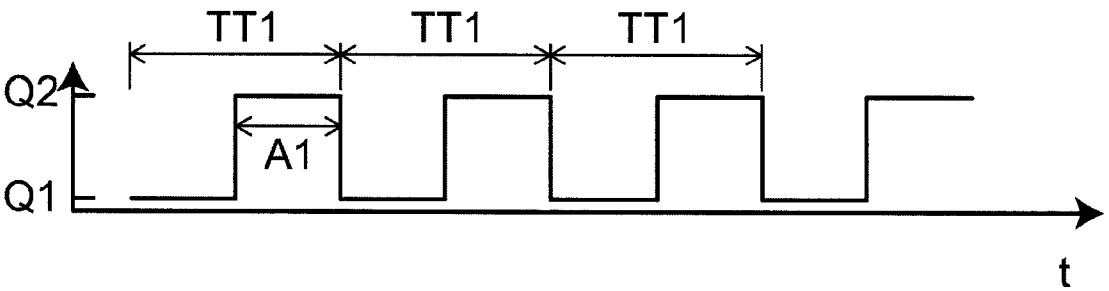

FIGS. 19A and 19B are graphs illustrating a specific example of the jetting flow rate from the jetting unit with respect to time.

Figure 20A:
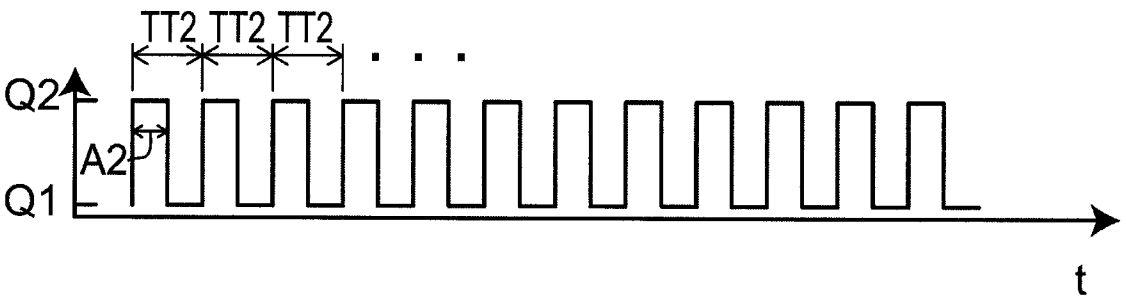
FIGS. 20A and 20B illustrate states of the jetting flow rate of the bathtub device according to the embodiment of the invention.
Figure 20B:
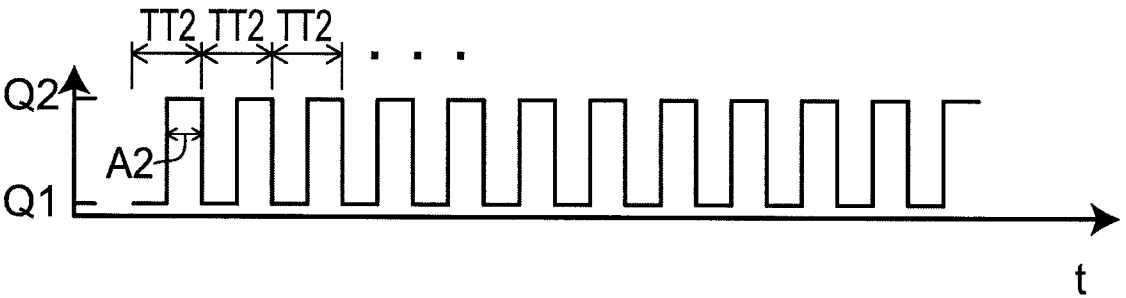

FIGS. 20A and 20B are graphs illustrating another specific example of the jetting flow rate from the jetting unit with respect to time.

The horizontal axis of FIGS. 19A and 19B and FIGS. 20A and 20B represents time t. The vertical axis of FIG. 19A and FIG. 20A represents the jetting flow rate QL jetted from the first jetting unit 3L. The vertical axis of FIG. 19B and FIG. 20B represents the jetting flow rate QR jetted from the second jetting unit 3R.

Here, the cycle TT1 of the jet flow state shown in FIGS. 19A and 19B is longer than the cycle TT2 of the jet flow state shown in FIGS. 20A and 20B.

First, with water (hot water) W stored in the bathtub 2, a bather M gets in the bathtub 2 and assumes a bathing posture (see, e.g., FIG. 7). More specifically, the bather M brings the buttocks into contact with the bottom surface 2*c* of the bathtub 2, brings the back m1 into contact with the first bathtub wall surface 2*a* of the bathtub 2, and opposes the soles m2 to the second bathtub wall surface 2*b*. Then, the bather M places the left and right feet so as to cover the left first jetting unit 3L with the left sole m2 and cover the right second jetting unit 3R with the right sole m2. Thus, the bather M assumes an initial posture to catch the jet flow jetted from the jetting unit 3 with the soles m2. At this time, the bather M is in a relaxed state. It is assumed that the ankle joint, knee joint, and hip joint are relaxed.

In this state, the jetting driving unit 4 is activated. Thus, the jetting driving unit 4 pumps water in the bathtub 2 from the suction port 4*s* to generate a jet flow, and supplies the jet flow to the jetting unit 3. At this time, the jetting flow rate with respect to time of the jet flow jetted from each of the first and second jetting units 3L and 3R is as shown in FIGS. 19A and 19B or FIGS. 20A and 20B.

More specifically, in both of FIGS. 19A and 19B and FIGS. 20A and 20B, the duty ratio representing the ratio (proportion) of the time of jetting flow rate Q2 to the cycle (cycle TT1 or TT2) is 0.5. However, this duty ratio (0.5) is illustrative only, and not limited thereto.

Here, a specific example is described with regard to the operation of varying the cycle without varying the duty ratio. Furthermore, in the following description, by way of example, the first jet flow state (jetting flow rate Q1) and the second jet flow state (jetting flow rate Q2) are alternately switched. The states of jet flow from the first jetting unit 3L for the left leg and the second jetting unit 3R for the right leg are in opposite phase. The term "cycle" used herein refers to the time from the start of a first jet flow state (jetting flow rate Q1) until the start of the next first jet flow state (jetting flow rate Q1), or the time from the start of a second jet flow state (jetting flow rate Q2) until the start of the next second jet flow state (jetting flow rate Q2).

When a jet flow of the jetting flow rate Q2 is squirted from the jetting unit 3, this jet flow presses the sole m2 of the bather M. For instance, when this jetting flow rate Q2 is jetted from the second jetting unit 3R, the right leg is shifted from the state of the right leg illustrated in FIG. 10B toward the state of the right leg illustrated in FIG. 10C. This state of the right leg is hereinafter referred to as bend phase. Likewise, when this jetting flow rate Q2 is jetted from the first jetting unit 3L, the left leg is also placed in the state of the bend phase. In such a bend phase, the ankle joint, knee joint, and hip joint of the bather M are simultaneously bent, and the foot of the bather M moves toward the first bathtub wall surface 2*a*. At this time, the jet flow from the jetting unit 3 generates a flow field so as to enclose the foot of the bather M. Hence, a force of preventing the foot from deviating from the jet flow is applied to the sole m2.

On the other hand, when a jet flow of the jetting flow rate Q1 is squirted from the jetting unit 3, the pressure pressing the sole m2 decreases. For instance, when this jetting flow rate Q1 is jetted from the second jetting unit 3R, the right leg is shifted from the state of the right leg illustrated in FIG. 10C toward the state of the right leg illustrated in FIG. 10D. This state of the right leg is hereinafter referred to as stretch phase. Likewise, when this jetting flow rate Q1 is jetted from the first jetting unit 3L, the left leg is also placed in the state of the stretch phase. In such a stretch phase, the ankle joint, knee joint, and hip joint of the bather M are naturally stretched, and the foot of the bather M moves toward the second bathtub wall surface 2*b*. At this time, for instance, the bather M consciously adjusts the position of the foot so as to cover the jetting unit 3 with the sole m2, and thereby the foot returns to the neighborhood of the jetting unit 3. Hence, by causing the jetting unit 3 to alternately squirt the jet flow of the jetting flow rates Q1 and Q2, the foot of the bather M reciprocates along the longitudinal direction of the bathtub 2.

Here, in the case where the cycle of the state of jet flow from the jetting unit 3 is relatively long like the cycle TT1 of FIG. 19A, the state of the ankle joint, knee joint, and hip joint of the bather M being simultaneously bent and stopped, i.e., the state of retain phase, lasts relatively long. After the retain phase lasts relatively long, a jet flow of the jetting flow rate Q1 is jetted from the jetting unit 3. Hence, the ankle joint, knee joint, and hip joint of the bather M transition to the aforementioned stretch phase. After this stretch phase lasts for a while (here, duration A1), the jet flow of the jetting flow rate Q2 is jetted again from the jetting unit 3. Hence, the ankle joint, knee joint, and hip joint of the bather M transition to the bend phase.

Thus, in the case where the cycle of the state of jet flow from the jetting unit 3 is relatively long, the time of the bend phase, retain phase, and stretch phase of the ankle joint, knee joint, and hip joint of the bather M lasts relatively long. Hence, the exercise of the leg of the bather M in this case is similar to stretching exercise or balance training. The bather M is caused to lose the balance of the posture by this exercise and takes an unstable posture. Hence, the bather M performs a compensating motion for unconsciously exerting the muscles throughout the body to stabilize the posture. This can also cause the bather M to exercise.

On the other hand, in the case where the cycle of the state of jet flow from the jetting unit 3 is relatively short like the cycle TT2 of the graph shown in FIGS. 20A and 20B, the state of the ankle joint, knee joint, and hip joint of the bather M being simultaneously bent and stopped, i.e., the state of retain phase, does not substantially exist. That is, in the case where the cycle is relatively short, the ankle joint, knee joint, and hip joint of the bather M transition generally continuously from the bend phase to the stretch phase. Furthermore, the ankle joint, knee joint, and hip joint of the bather M are naturally stretched, and then transition again to the bend phase.

Thus, in the case where the cycle of the state of jet flow from the jetting unit 3 is relatively short, the retain phase of the ankle joint, knee joint, and hip joint of the bather M does not substantially exist. The bend phase and the stretch phase transition alternately and generally continuously. The first and second jetting units 3L and 3R alternately squirt a jet flow. Thus, the left and right feet of the bather M reciprocate in opposite phase. Hence, the legs of the bather M in this case undergo bending/stretching exercise like walking exercise. Although more stable than in the case of the cycle TT1, the bather M is caused to lose the balance of the posture by this exercise. Hence, the bather M performs a compensating motion for unconsciously exerting the muscles throughout the body to stabilize the posture. This can also cause the bather M to exercise.

As described above, by varying the cycle of the state of jet flow from the jetting unit 3, the exercise mode of the bather M can be changed. That is, by varying the cycle of the state of jet flow from the jetting unit 3, the bather M can change between an exercise similar to stretching exercise or balance training, and a bending/stretching exercise like walking exercise. Thus, the bather M can continue these exercises without being bored with exercise.

Furthermore, this exercise is a passive exercise applied externally, and not an active exercise done by the will of the bather M. Hence, this exercise depends little on the will power of the bather M and is easily continued. Furthermore, this exercise can be done while in the bathing posture. Hence, the bather M can exercise in a relaxed state. As a result, the exercise is easy to continue. Here, the term "passive exercise" refers to an exercise which one conducts not by using one's own muscle force but by using an external force. In this specification, the "passive exercise" also includes the compensating motion in the disturbed posture as described above. That is, it can be said that the bathtub device 1*f* according to this embodiment is an exercise bathtub device capable of causing a bather to do passive exercise while allowing the bather M in the sitting state.

Furthermore, by the thermal effect of bathing, the exercise effect is further improved. Furthermore, the temperature boundary layer around the bather M is constantly destroyed by the jet flow. Hence, the bather M is easily warmed, and the exercise effect is further improved. Thus, by doing the aforementioned exercise in the bathtub, a higher exercise effect can be achieved than in the case of doing the exercise outside the bathtub.

Figure 21:
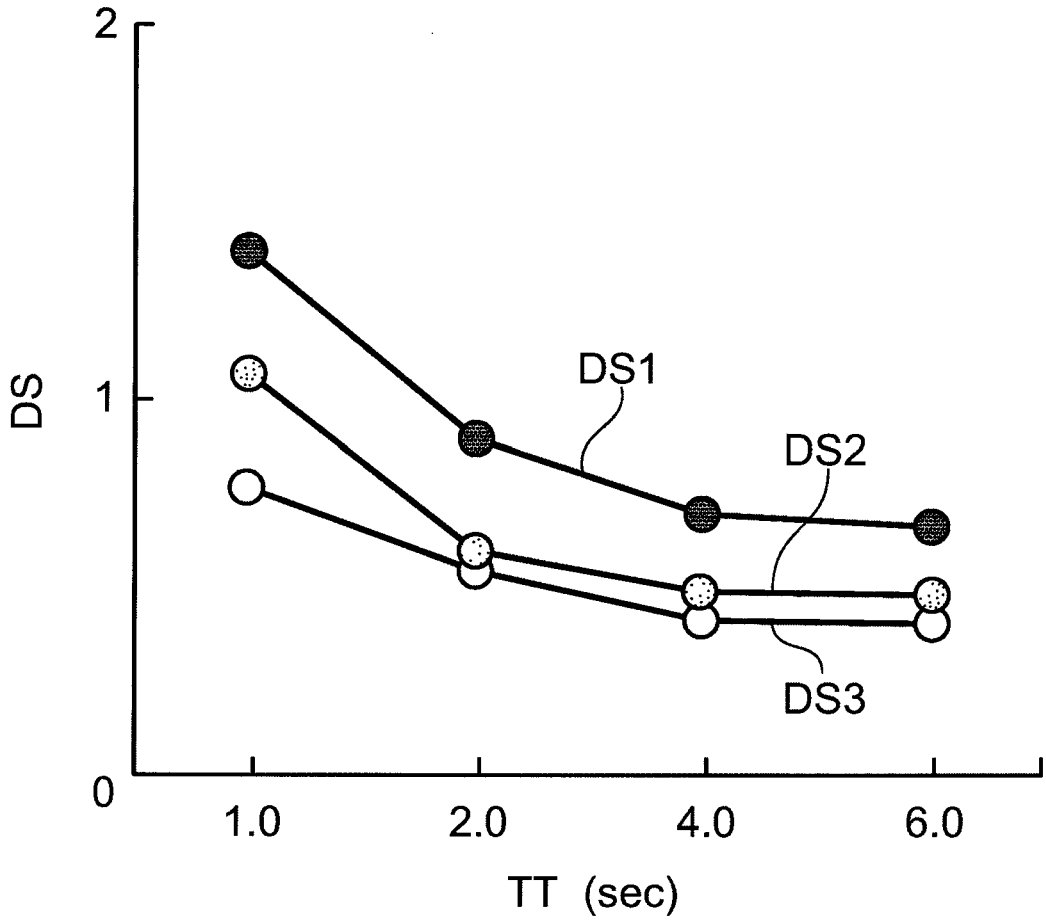
FIG. 21 illustrates characteristics of the bathtub device according to the embodiment of the invention.

FIG. 21 is a graph illustrating the trajectory stability of joints with respect to the cycle of the jet flow state.

The inventors had the bathtub device 1*f* according to this embodiment used by approximately 20 subjects and conducted a hearing survey on the feeling of stability of the trajectory of the ankle joint, knee joint, and hip joint. Based on the result of hearing from the subjects, the inventors established a trajectory stability index DS indicating the stability of the joint trajectory. The trajectory stability index DS approaches "2" when the joint trajectory is more stable, and approaches "0" when the joint trajectory is less stable. In FIG. 21, the horizontal axis represents the cycle TT used in the experiment, and the vertical axis represents the trajectory stability index DS. This figure shows the trajectory stability index DS1 for the ankle joint, the trajectory stability index DS2 for the knee joint, and the trajectory stability index DS3 for the hip joint.

According to the result of this hearing survey, as shown in FIG. 21, it was found that the subjects felt that the trajectory of the ankle joint, knee joint, and hip joint was stabilized with the decrease of the cycle TT of the state of jet flow from the jetting unit 3. More specifically, in the case where the cycle TT is approximately 4 to 6 seconds, the trajectory of the knee joint and hip joint is made more unstable. The subject is caused to lose the balance of the posture by this exercise. Thus, the subject performs a compensating motion for unconsciously exerting the muscles throughout the body to stabilize the posture. It was found that many subjects felt that the exercise at this time is similar to stretching exercise or balance training.

A human can walk stably by alternately swinging the left and right legs forward at a good pace with the cycle of repetitive motion being approximately 1 second, rather than at a slow pace (e.g., the cycle of repetitive motion being approximately 4 seconds). This is attributed to the speed and the force of inertia applied to the legs of the human, and to the action of the human musculoskeletal system and the control function of the nervous system called the rhythm generator (gait pattern generator). Like the normal gait on land, the bending/stretching exercise of the left and right legs during bathing can also realize alternate bending/stretching exercise between left and right more stably in the case where the cycle TT is approximately 1 to 2 seconds than in the case where the cycle TT is approximately 4 to 6 seconds. Thus, in the case where the cycle TT is approximately 1 to 2 seconds, the user (bather M) can comfortably do bending/stretching exercise of the legs, and realize the bending/stretching exercise without being subjected to extra load. Furthermore, because the cycle TT is approximately 1 to 2 seconds, the bather M can be provided with bending/stretching exercises stimulating many leg muscle groups in a short time as compared with the case where the cycle TT is approximately 4 to 6 seconds. Furthermore, the left and right feet of the subject reciprocate with a shorter cycle and in opposite phase. Thus, it was found that in this exercise, many subjects experienced the feeling of exercise like walking exercise.

Figures 22A, 22B:
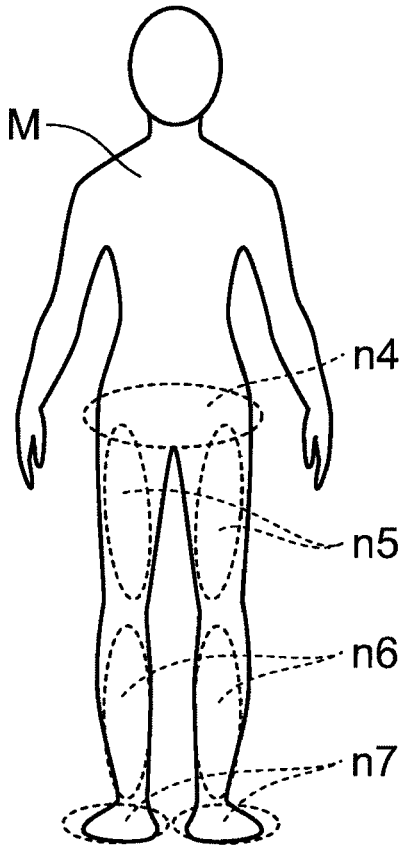
FIGS. 22A and 22B illustrate results of experimental use of the bathtub device according to the embodiment of the invention.

FIGS. 22A and 22B are a table and a schematic view illustrating the sites of muscle groups used depending on the cycle of the jet flow state.

Here, FIG. 22A is a table illustrating the sites of muscle groups in which the subjects experienced the feeling of use by the bathtub device 1*f* according to this embodiment. FIG. 22B is a schematic view showing the sites of muscle groups listed in FIG. 22A.

More specifically, the inventors had the bathtub device 1*f* according to this embodiment used by seven subjects (subjects P1 to P7) and conducted a hearing survey on the sites of muscle groups in which the subjects experienced the feeling of use for different cycles TT.

For the seven subjects P1 to P7, FIG. 22A shows the sites PS where the feeling of use was experienced when the cycle is set to a short cycle TT, and the sites PL where the feeling of use was experienced when the cycle is set to a long cycle.

According to the result of this hearing survey, as shown in FIG. 22A, it was found that in the case where the cycle TT of the jet flow state was short, the subjects experienced the feeling of use in the sites PS of muscle groups of at least one of the hip joint n4 and the thigh n5.

The muscle groups of the hip joint n4 include the iliacus muscle, the psoas major muscle, and the adductor longus muscle. The muscle groups of the thigh n5 include the quadriceps femoris muscle and the hamstrings. The hamstrings are a muscle group including the biceps femoris muscle, the semimembranosus muscle, the semitendinosus muscle, and the adductor magnus muscle. The biceps femoris muscle is known as a muscle acting primarily to generate a kick-out force and propulsive force in walking. Hence, the exercise stimulating the hamstrings of the thigh n5 means an exercise capable of contributing to maintenance of walking speed and improvement of walking function. Thus, it was found that in the case where the cycle TT of the jet flow state was short, the subjects experienced the feeling of exercise like walking exercise.

On the other hand, it was found that in the case where the cycle of the jet flow state was long, the subjects experienced the feeling of use in the sites PL of muscle groups of at least one of the thigh n5, the lower leg n6, and the foot n7. The muscle groups of the lower leg n6 and the foot n7 include the triceps surae muscle. The triceps surae muscle is a muscle group including the tibialis anterior muscle, the gastrocnemius muscle, and the soleus muscle. The tibialis anterior muscle is known as a muscle acting to provide clearance between the ground and the foot n7 in walking. Thus, the exercise of activating the tibialis anterior muscle means an exercise contributing to fall prevention. Thus, it was found that in the case where the cycle of the jet flow state was long, the subjects experienced an exercise similar to stretching exercise or balance training.

Next, a specific example of the operation of varying the duty ratio without varying the cycle TT is described.

Figures 23A, 23B, 23C:
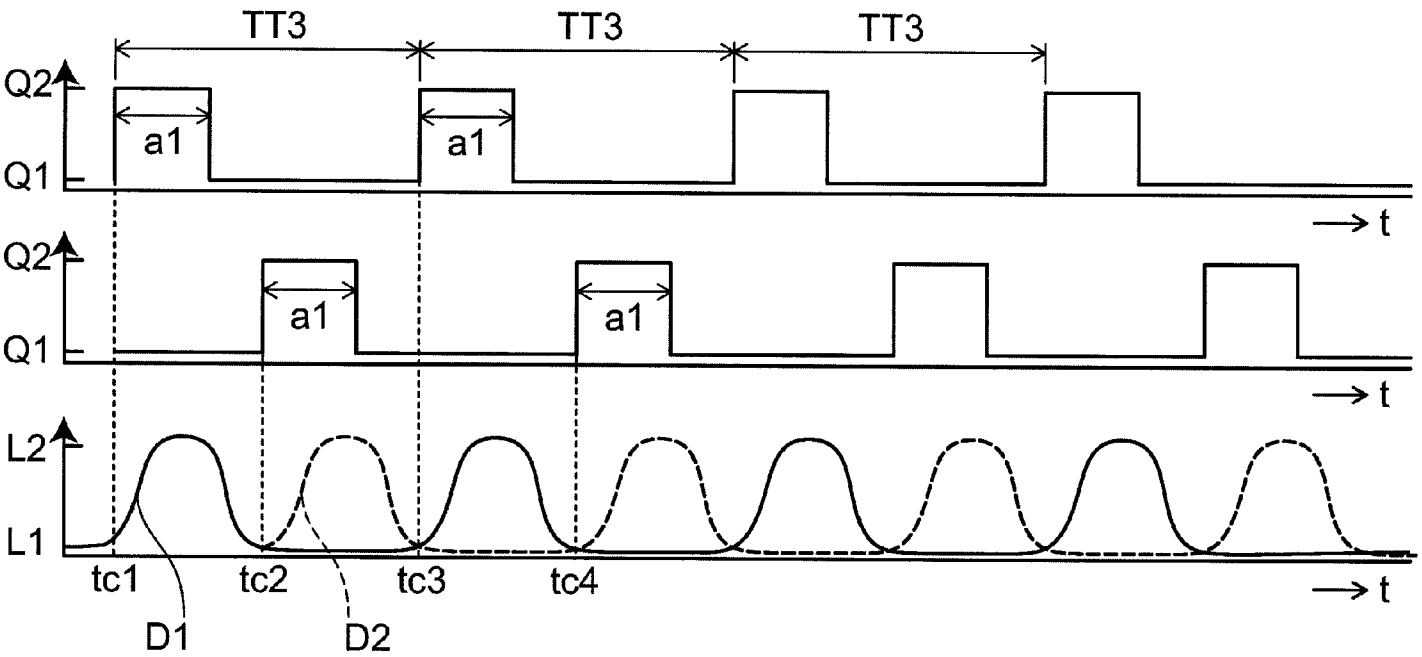
FIGS. 23A to 23C show the relationship between the jetting flow rate of the bathtub device according to the embodiment of the invention and the state of the leg of a bather.

FIGS. 23A to 23C are graphs illustrating a specific example of the variation of the jetting flow rate from the jetting unit with respect to time and the variation of the distance from the second bathtub wall surface to the sole with respect to time.

Figure 24:
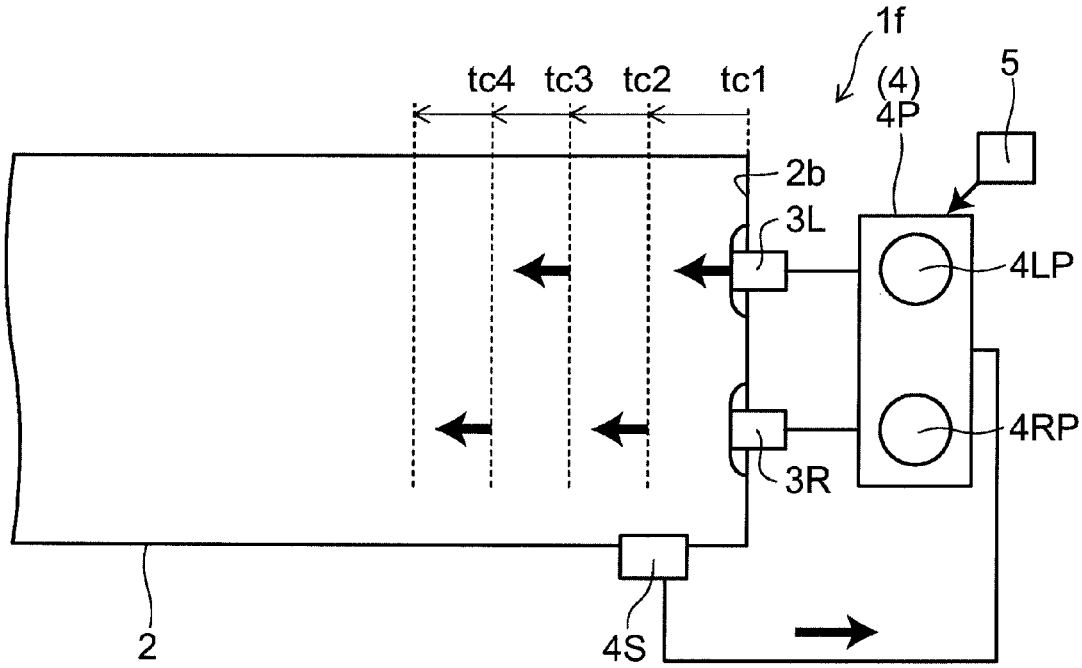
FIG. 24 is a schematic plan view illustrating the operation of a bathtub device according to the embodiment of the invention.

FIG. 24 is a schematic plan view showing the operation of a bathtub device according to this specific example.

Figure 25:
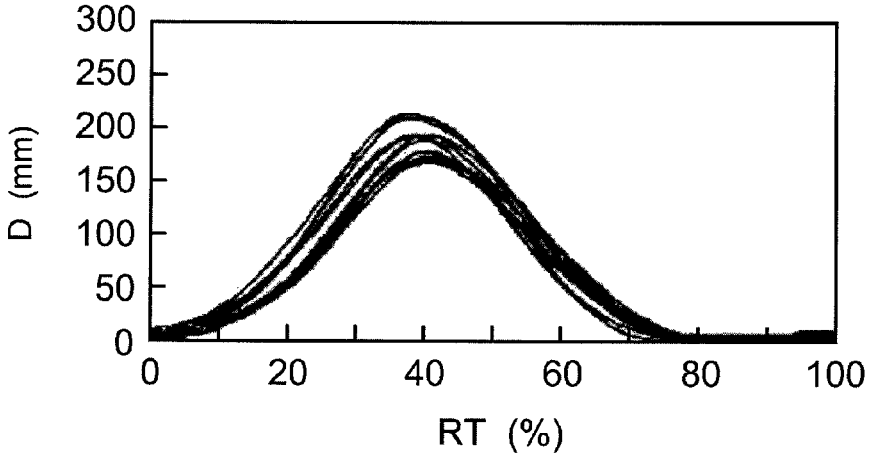
FIG. 25 illustrates results of experimental use of the bathtub device according to the embodiment of the invention.

FIG. 25 is a graph illustrating the measured values of the distance from the second bathtub wall surface to the sole in using the bathtub device according to this specific example.

The vertical axis of FIG. 23A represents the jetting flow rate QL of the jet flow from the first jetting unit 3L. The vertical axis of FIG. 23B represents the jetting flow rate QR of the jet flow from the second jetting unit 3R. The vertical axis of FIG. 23C represents the distance D with respect to time from the second bathtub wall surface 2*b* to the sole m2. Here, FIG. 23C shows the distance D1 between the left sole m2 and the second bathtub wall surface 2*b*, and the distance D2 between the right sole m2 and the second bathtub wall surface 2*b*. The horizontal axis of FIGS. 23A to 23C represents time t.

As shown in FIGS. 23A and 23B, the duty ratio (a1/TT3) in this specific example is relatively low, such as approximately 0.3 to 0.4. The first jet flow state (jetting flow rate Q1) and the second jet flow state (jetting flow rate Q2) are alternately switched. This jet flow state (operating state) in plan view is as shown in FIG. 24.

More specifically, at time tc1, jetting is started in the second jet flow state (jetting flow rate Q2) from the first jetting unit 3L. Here, the length of arrows shown in FIG. 24 corresponds to the length of time a1 of the jetting flow rate Q2 shown in FIGS. 23A and 23B. Subsequently, at time tc2, jetting is started at the jetting flow rate Q2 from the second jetting unit 3R. Next, at time tc3, jetting is started again at the jetting flow rate Q2 from the first jetting unit 3L. Next, at time tc4, jetting is started again at the jetting flow rate Q2 from the second jetting unit 3R. Here, in the time ranges where no arrow is depicted in FIG. 24, jetting is performed in the first jet flow state (jetting flow rate Q1) from the first and second jetting units 3L and 3R.

On the other hand, as shown in FIG. 23C, the distance D (distance D1 and distance D2) from the second bathtub wall surface 2*b* to the sole m2 is varied between a short distance L1 and a relatively long distance L2.

In this specific example, the duty ratio is relatively low, such as approximately 0.3 to 0.4. In this case, as shown in FIG. 23C, the duration when the distance D (distance D1 and distance D2) from the second bathtub wall surface 2*b* to the sole m2 is the short distance L1, i.e., the duration of stretch phase when the ankle joint, knee joint, and hip joint of the bather M are naturally stretched, is relatively long. On the other hand, the duration when the distance D (distance D1 and distance D2) from the second bathtub wall surface 2*b* to the sole m2 is long (L2), i.e., the duration of retain phase when the ankle joint, knee joint, and hip joint of the bather M are simultaneously bent and stopped, is relatively short.

This can also be determined from the measured values of the distance D from the second bathtub wall surface 2*b* to the sole m2 in using the bathtub device according to this specific example. The inventors measured the distance D from the second bathtub wall surface 2*b* to the sole m2 for approximately 10 roundtrips in using the bathtub device 1*f* according to this specific example. The term "one roundtrip" used herein refers to the motion from the stretch phase, in which the ankle joint, knee joint, and hip joint of the bather M are naturally stretched, transitioning to the bend phase until returning again to the stretch phase in which they are naturally stretched.

An example of the measured values is as shown in FIG. 25. The horizontal axis of FIG. 25 represents the ratio RT of time elapsed during one roundtrip (one cycle TT). The time for RT=0% corresponds to the start time of one cycle TT, and the time for RT=100% corresponds to the end time of one cycle TT (which coincides with the start time). The vertical axis of FIG. 25 represents the distance D (distance D1 and distance D2) from the second bathtub wall surface 2*b* to the sole m2.

As seen also from the measured values shown in FIG. 25, as described above, the duration of stretch phase when the ankle joint, knee joint, and hip joint of the bather M are naturally stretched (the duration of the distance D being short) is relatively long. On the other hand, the duration of retain phase when they are simultaneously bent and stopped (the duration of the distance D being long) is relatively short.

Thus, as in this specific example, in the case where the duty ratio is relatively low, such as approximately 0.3 to 0.4, the exercise is similar to stretching exercise. As described later with reference to FIG. 32, this can also be determined by a hearing survey from subjects who used the bathtub device 1*f* according to this specific example. That is, an exercise similar to stretching exercise can be realized by setting the duty ratio to be relatively low, such as approximately 0.3 to 0.4.

Figures 26A, 26B, 26C:
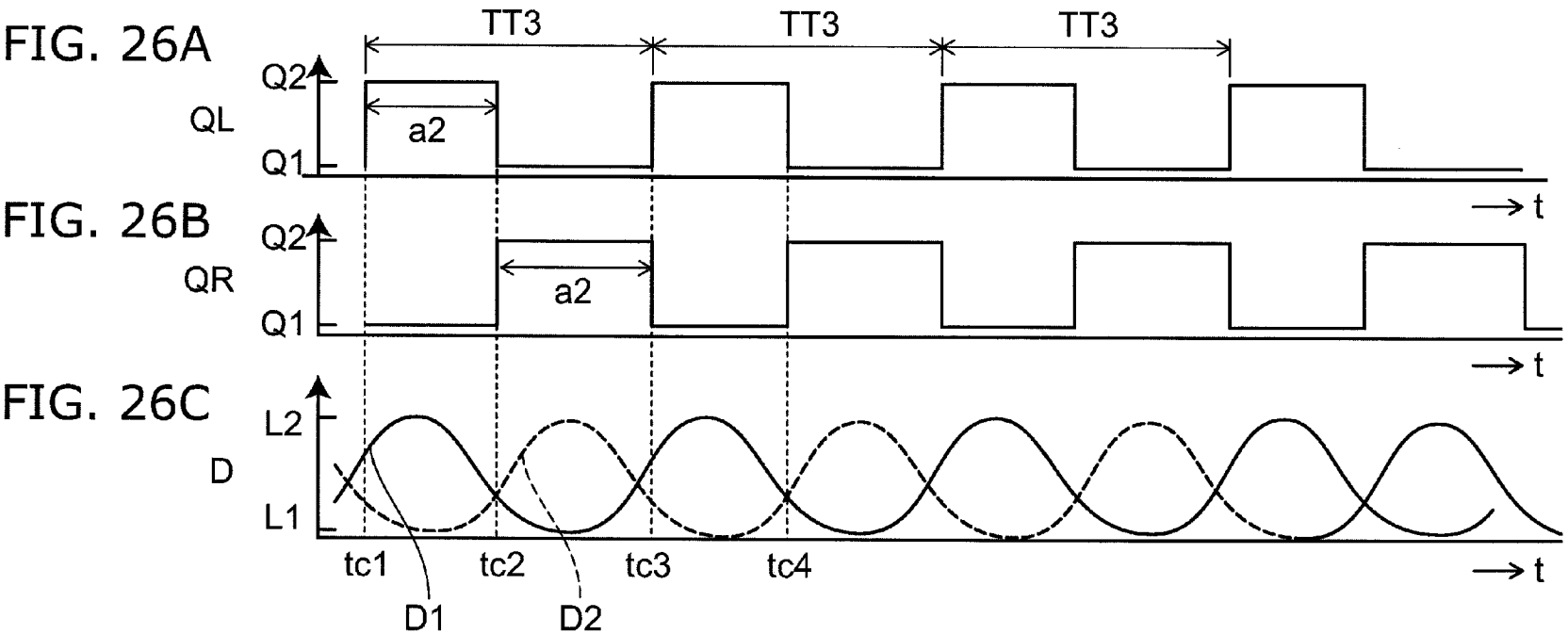
FIGS. 26A to 26C show the relationship between the jetting flow rate of the bathtub device according to the embodiment of the invention and the state of the leg of a bather.

FIGS. 26A to 26C are graphs illustrating another specific example of the variation of the jetting flow rate from the jetting unit with respect to time and the variation of the distance from the second bathtub wall surface to the sole with respect to time.

Figure 27:
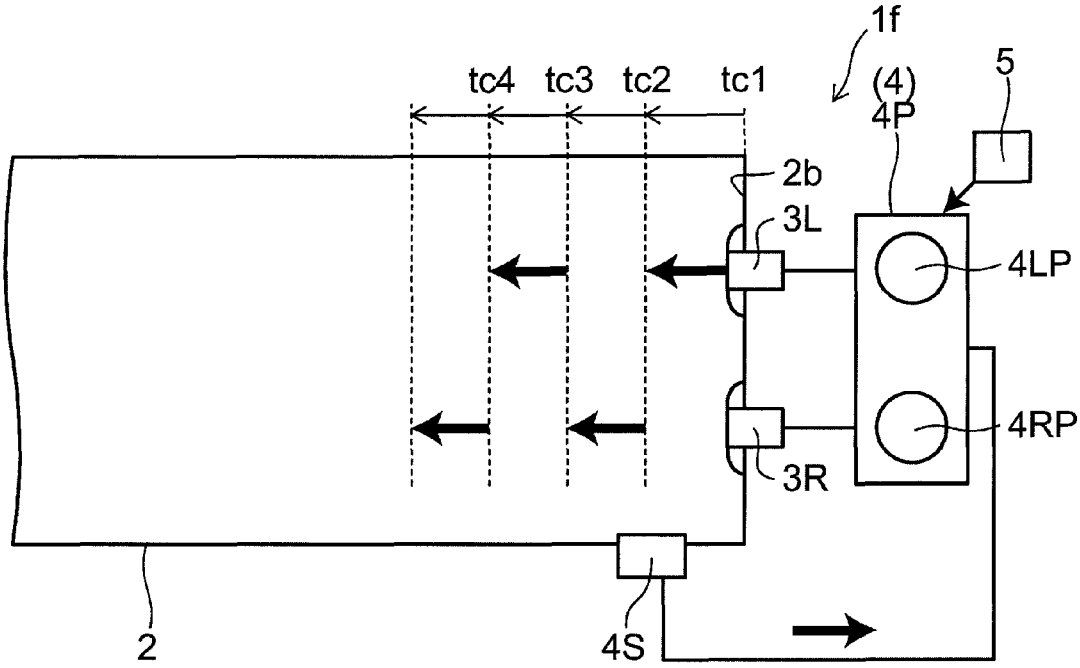
FIG. 27 is a schematic plan view illustrating the operation of the bathtub device according to the embodiment of the invention.

FIG. 27 is a schematic plan view showing the operation of a bathtub device according to this specific example.

Figure 28:
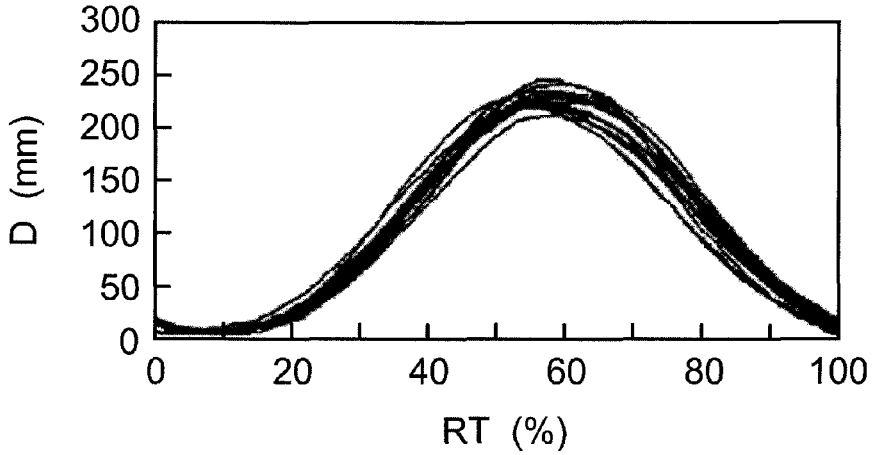
FIG. 28 illustrates results of experimental use of the bathtub device according to the embodiment of the invention.

FIG. 28 is a graph illustrating the measured values of the distance from the second bathtub wall surface to the sole in using the bathtub device according to this specific example.

As shown in FIGS. 26A and 26B, the duty ratio (a2/TT3) in this specific example is approximately 0.5 to 0.6. That is, the duty ratio (a2/TT3) in this specific example is higher than the duty ratio (a1/TT3) illustrated in FIGS. 23A and 23B. However, the cycle TT3 of the jet flow state shown in FIGS. 26A and 26B is equal to the cycle TT3 of the jet flow state illustrated in FIGS. 23A and 23B. Furthermore, the first jet flow state (jetting flow rate Q1) and the second jet flow state (jetting flow rate Q2) are alternately switched and in opposite phase. This jet flow state (operating state) in plan view is as shown in FIG. 27.

At time tc1, jetting is started in the second jet flow state (jetting flow rate Q2) from the first jetting unit 3L. Here, like the length of arrows shown in FIG. 24, the length of arrows shown in FIG. 27 corresponds to the length of time a2 of the jetting flow rate Q2 shown in FIGS. 26A and 26B. Subsequently, at time tc2, jetting is started at the jetting flow rate Q2 from the second jetting unit 3R. Next, at time tc3, jetting is started again at the jetting flow rate Q2 from the first jetting unit 3L. Next, at time tc4, jetting is started again at the jetting flow rate Q2 from the second jetting unit 3R. Here, in the time ranges where no arrow is depicted in FIG. 27, jetting is performed in the first jet flow state (jetting flow rate Q1) from the first and second jetting units 3L and 3R.

In this specific example, the duty ratio is approximately 0.5 to 0.6. In this case, as shown in FIG. 26C, the duration when the distance D from the second bathtub wall surface 2*b* to the sole m2 is the short distance L1, i.e., the duration of stretch phase when the ankle joint, knee joint, and hip joint of the bather M are naturally stretched, is relatively short. Likewise, the duration when the distance D from the second bathtub wall surface 2*b* to the sole m2 is the long distance L2, i.e., the duration of retain phase when the ankle joint, knee joint, and hip joint of the bather M are simultaneously bent and stopped, is relatively short. That is, the left and right feet of the bather M reciprocate generally continuously in opposite phase. The stationary state does not substantially exist.

This can also be determined from the measured values of the distance D from the second bathtub wall surface 2*b* to the sole m2 in using the bathtub device 1*f* according to this specific example. The inventors measured the distance D from the second bathtub wall surface 2*b* to the sole m2 for approximately 10 roundtrips in using the bathtub device 1*f* according to this specific example. An example of the measured values is as shown in FIG. 28.

As seen also from the measured values shown in FIG. 28, as described above, the duration of stretch phase when the ankle joint, knee joint, and hip joint of the bather M are naturally stretched, and the duration of retain phase when they are simultaneously bent and stopped, are both relatively short.

Thus, as in this specific example, in the case where the duty ratio is approximately 0.5 to 0.6, the exercise is a bending/stretching exercise like walking exercise. As described later with reference to FIG. 32, this can also be determined by a hearing survey from subjects who used the bathtub device 1*f* according to this specific example. That is, a bending/stretching exercise like walking exercise can be realized by setting the duty ratio to approximately 0.5 to 0.6.

Figures 29A, 29B, 29C:
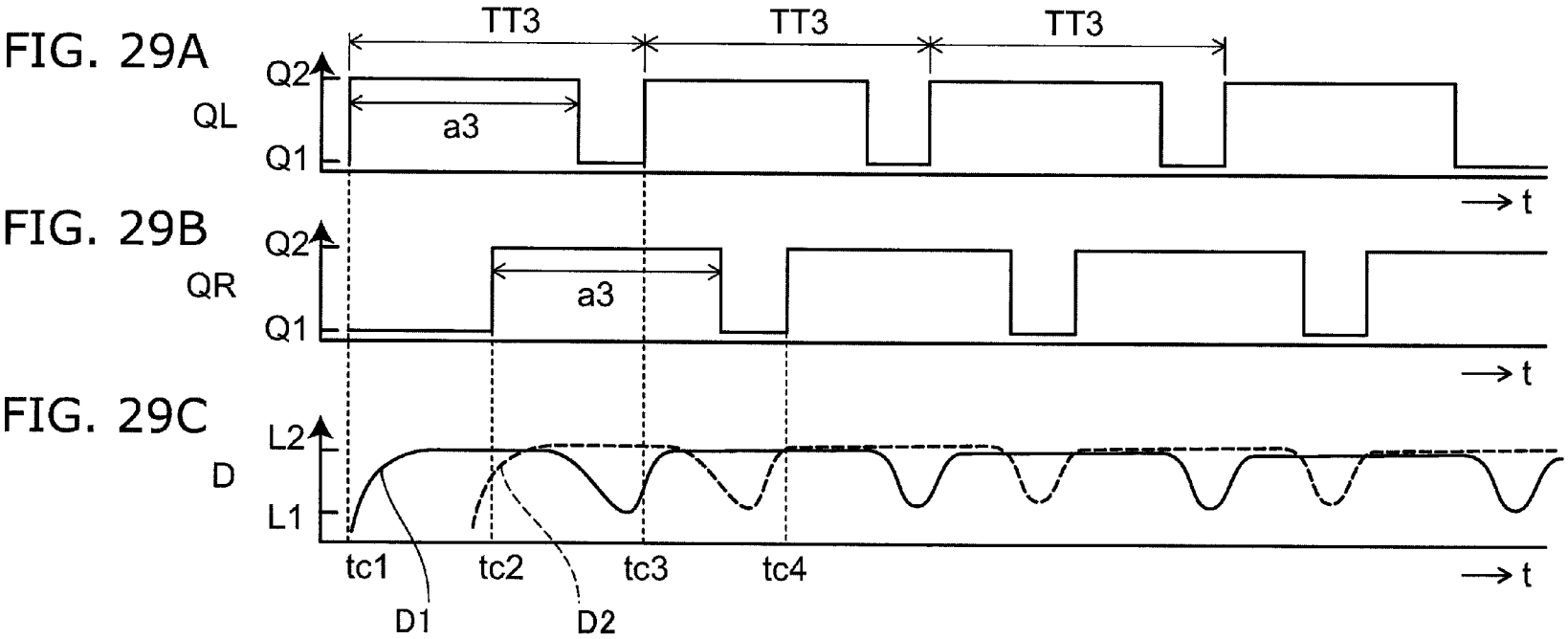
FIGS. 29A to 29C show the relationship between the jetting flow rate of the bathtub device according to the embodiment of the invention and the state of the leg of a bather.

FIGS. 29A to 29C are graphs illustrating still another specific example of the variation of the jetting flow rate from the jetting unit with respect to time and the variation of the distance from the second bathtub wall surface to the sole with respect to time.

Figure 30:
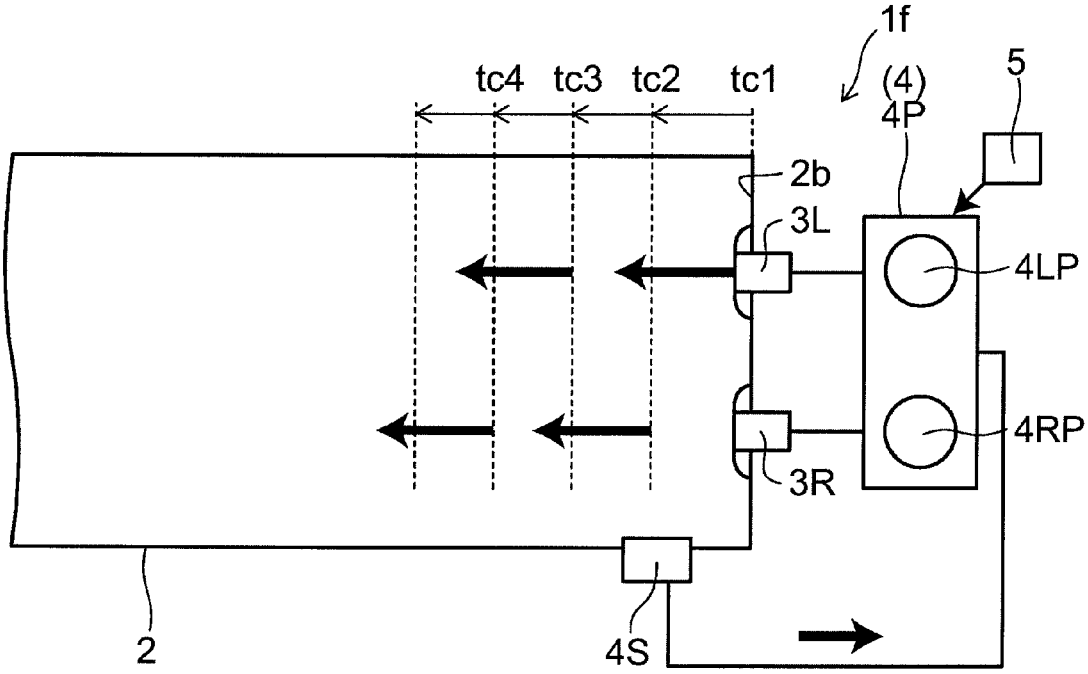
FIG. 30 is a schematic plan view illustrating the operation of the bathtub device according to one embodiment of the invention.

FIG. 30 is a schematic plan view showing the operation of a bathtub device according to this specific example.

Figure 31:
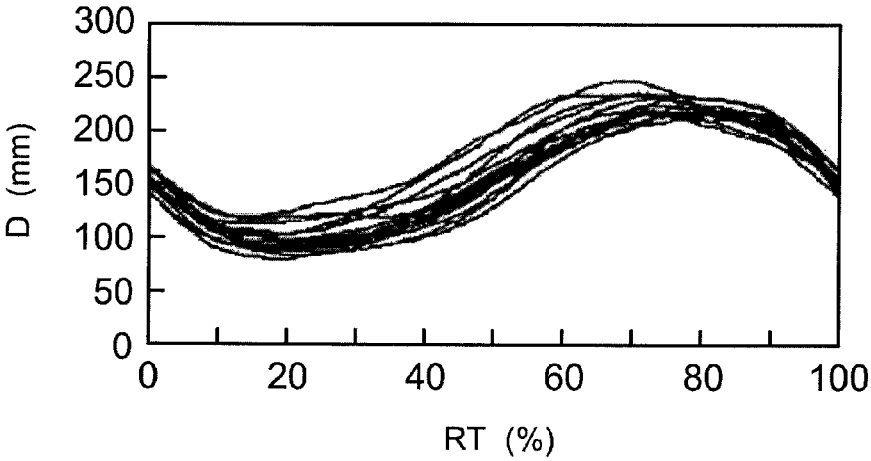
FIG. 31 illustrates results of experimental use of the bathtub device according to the embodiment of the invention.

FIG. 31 is a graph illustrating the measured values of the distance from the second bathtub wall surface to the sole in using the bathtub device according to this specific example.

As shown in FIGS. 29A and 29B, the duty ratio (a3/TT3) in this specific example is relatively high, such as approximately 0.7 to 0.8. That is, the duty ratio (a3/TT3) in this specific example is higher than the duty ratio (a1/TT3) of the graphs shown in FIGS. 23A and 23B, and the duty ratio (a2/TT3) of the graph shown in FIGS. 26A and 26B. However, the cycle TT3 of the jet flow state shown in FIGS. 29A to 29C is equal to the cycle TT3 of the jet flow state shown in FIGS. 23A to 23C and FIGS. 26A to 26C. Furthermore, the first jet flow state (jetting flow rate Q1) and the second jet flow state (jetting flow rate Q2) are alternately switched. This jet flow state (operating state) in plan view is as shown in FIG. 30.

At time tc1, jetting is started in the second jet flow state (jetting flow rate Q2) from the first jetting unit 3L. Here, like the length of arrows shown in FIG. 24, the length of arrows shown in FIG. 30 corresponds to the length of time a3 of the jetting flow rate Q2 shown in FIGS. 29A and 29B. Subsequently, at time tc2, jetting is started at the jetting flow rate Q2 from the second jetting unit 3R. Next, at time tc3, jetting is started again at the jetting flow rate Q2 from the first jetting unit 3L. Next, at time tc4, jetting is started again at the jetting flow rate Q2 from the second jetting unit 3R. Here, in the time ranges where no arrow is depicted in FIG. 30, jetting is performed in the first jet flow state (jetting flow rate Q1) from the first and second jetting units 3L and 3R.

In this specific example, the duty ratio is relatively high, such as approximately 0.7 to 0.8. In this case, as shown in FIG. 29C, the duration when the distance D from the second bathtub wall surface 2*b* to the sole m2 is the short distance L1, i.e., the duration of stretch phase when the ankle joint, knee joint, and hip joint of the bather M are naturally stretched, does not substantially exist. On the other hand, the duration when the distance D from the second bathtub wall surface 2*b* to the sole m2 is the long distance L2, i.e., the duration of retain phase when the ankle joint, knee joint, and hip joint of the bather M are simultaneously bent and stopped, is relatively long. That is, even if the leg of the bather M is stretched so that the sole is in contact with the second bathtub wall surface 2*b* or the jetting unit 3, the leg is again bent and stopped before contact.

This can also be determined from the measured values of the distance D from the second bathtub wall surface 2*b* to the sole m2 in using the bathtub device 1*f* according to this specific example. The inventors measured the distance from the second bathtub wall surface 2*b* to the sole m2 for approximately 10 roundtrips in using the bathtub device 1 according to this specific example. An example of the measured values is as shown in FIG. 31.

As seen also from the measured values shown in FIG. 31, as described above, the duration of stretch phase when the ankle joint, knee joint, and hip joint of the bather M are naturally stretched does not substantially exist. On the other hand, the duration of retain phase when they are bent and stopped is relatively long.

Thus, as in this specific example, in the case where the duty ratio is relatively high, such as approximately 0.7 to 0.8, the exercise is similar to balance training. As described later with reference to FIG. 32, this can also be determined by a hearing survey from subjects who used the bathtub device 1*f* according to this specific example. That is, an exercise similar to balance exercise can be realized by setting the duty ratio to be relatively high, such as approximately 0.7 to 0.8.

It is for the cycle TT3 of the jet flow state in this specific example that even if the leg of the bather M is stretched so that the sole is in contact with the second bathtub wall surface 2*b* or the jetting unit 3, the leg is again bent and stopped before contact. For instance, for a cycle longer than the cycle TT3, the leg of the bather M is stretched and may be in contact with the second bathtub wall surface 2*b* or the jetting unit 3.

FIG. 32 is a table illustrating the survey result on the relationship between the duty ratio of the jet flow state and the exercise mode felt in response thereto.

The inventors had the bathtub device 1*f* according to this embodiment used by subjects and conducted a hearing survey on the exercise modes felt by the subjects (subject PA to subject PD) for different duty ratios DR of the jet flow state. The exercise modes EM felt are broadly divided into the stretching exercise E1, walking exercise E2 (natural exercise similar to walking), and balance training E3.

In the case where the duty ratio DR is relatively low, such as approximately 0.3 to 0.4 (30 to 40%), as described above with reference to FIG. 23A to FIG. 25, the duration of stretch phase when the ankle joint, knee joint, and hip joint of the bather M are naturally stretched is relatively long. On the other hand, the duration of retain phase when they are simultaneously bent and stopped is relatively short.

Thus, as shown in FIG. 32, the exercise mode EM felt by the subjects in this case was largely the stretching exercise E1. It was found that many subjects felt that such exercise was similar to stretching exercise E1.

In the case where the duty ratio is approximately 0.5 to 0.6 (50 to 60%), as described above with reference to FIG. 26A to FIG. 28, the duration of stretch phase when the ankle joint, knee joint, and hip joint of the bather M are naturally stretched, and the duration of retain phase when they are simultaneously bent and stopped, are both relatively short. That is, the left and right feet of the subject reciprocate generally continuously in opposite phase. The stationary state does not substantially exist.

Thus, as shown in FIG. 32, the exercise mode EM felt by the subjects in this case was largely the walking exercise E2. It was found that many subjects felt that such exercise was similar to natural walking exercise E2.

In the case where the duty ratio is relatively high, such as approximately 0.7 to 0.8 (70 to 80%), as described above with reference to FIG. 29A to FIG. 31, the duration of stretch phase when the ankle joint, knee joint, and hip joint of the bather M are naturally stretched does not substantially exist. On the other hand, the duration of retain phase when they are bent and stopped is relatively long. That is, the motion of the left and right legs of the subject is similar to walking in the air, or sitting on a so-called "balance ball".

Thus, as shown in FIG. 32, the exercise mode EM felt by the subjects in this case was largely the balance training E3. It was found that many subjects felt that such exercise was similar to balance training E3.

As described above, the exercise mode of the bather M can be changed also by varying the duty ratio of the state of jet flow from the jetting unit 3. That is, by varying the duty ratio of the state of jet flow from the jetting unit 3, the bather M can change among an exercise similar to stretching exercise, a bending/stretching exercise like walking exercise, and an exercise similar to balance training. Thus, the bather M can continue these exercises without being bored with exercise. With regard to other effects, similar effects to those described earlier can be achieved.

Figures 33A, 33B:
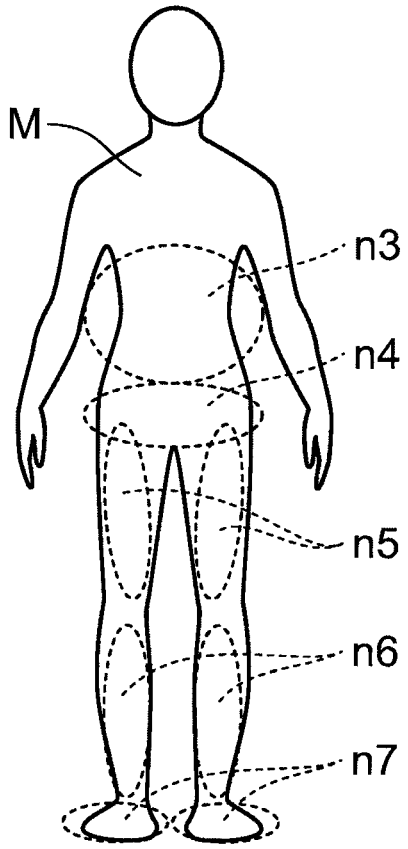
FIGS. 33A and 33B illustrate results of experimental use of the bathtub device according to the embodiment of the invention.

FIGS. 33A and 33B are a table and a schematic view illustrating the sites of muscle groups used depending on the duty ratio of the jet flow state.

Here, FIG. 33A is a table illustrating the sites of muscle groups in which the subjects experienced the feeling of use by the bathtub device 1*f* according to this embodiment. FIG. 33B is a schematic view showing the sites of muscle groups listed in FIG. 33A.

More specifically, the inventors had the bathtub device according to this embodiment used by seven subjects (subject P1 to subject P7) and conducted a hearing survey on the sites of muscle groups in which the subjects experienced the feeling of use for different duty ratios DR.

According to the result of this hearing survey, as shown in FIG. 33A, it was found that in the case where the duty ratio DR of the jet flow state was relatively low, such as approximately 0.3 to 0.4 (30 to 40%), the subjects experienced the feeling of use in the muscle groups of at least one of the abdomen/trunk n3, the hip joint n4, the thigh n5, the lower leg n6, and the foot n7. That is, it was found that the feeling of use was experienced in muscle groups in a relatively wide range.

The muscle groups of the abdomen/trunk n3 include the erector spinae muscles, the rectus abdominis muscle, and the abdominal oblique muscles. As described above with reference to FIGS. 22A and 22B, the muscle groups of the lower leg n6 and the foot n7 include the tibialis anterior muscle. The tibialis anterior muscle is known as a muscle acting to provide clearance between the ground and the foot n7 in walking. Thus, the exercise of activating the tibialis anterior muscle means an exercise contributing to fall prevention. Thus, it was found that in the case where the duty ratio of the jet flow state was relatively low, such as approximately 0.3 to 0.4, the subjects experienced the exercise similar to stretching exercise.

Furthermore, it was found that in the case where the duty ratio of the jet flow state was approximately 0.5 to 0.6, the subjects experienced the feeling of use in the muscle groups of at least one of the hip joint n4, the thigh n5, and the lower leg n6.

Furthermore, it was found that in the case where the duty ratio of the jet flow state was relatively high, such as approximately 0.7 to 0.8, the subjects experienced the feeling of use in the muscle groups of the hip joint n4 or the thigh n5. That is, it was found that in the case where the duty ratio of the jet flow state was approximately 0.5 to 0.6, and in the case where the duty ratio was relatively high, such as approximately 0.7 to 0.8, the feeling of use was experienced in muscle groups in a relatively narrow range.

As described above with reference to FIGS. 22A and 22B, the muscle groups of the thigh n5 include the biceps femoris muscle. The biceps femoris muscle is known as a muscle acting primarily to generate a kick-out force and propulsive force in walking. Hence, the exercise stimulating the hamstrings of the thigh n5 means an exercise capable of contributing to maintenance of walking speed and improvement of walking function. Thus, in the case where the duty ratio of the jet flow state is approximately 0.5 to 0.6, and in the case where the duty ratio is relatively high, such as approximately 0.7 to 0.8, the bending exercise and the stretching exercise in the leg are continuously done like walking exercise. Furthermore, these exercises are done in the state of floating in hot water. Hence, the exercise acts also on muscles other than the major muscles working in walking. Thus, it was found that the user experienced the feeling of exercise as an exercise including the factor of balance training.

Furthermore, the bathtub device 1*f* according to this embodiment also provides the activity of muscles by passive exercise similar to those described earlier.

Next, a specific example of the operation of varying the cycle and duty ratio is described.

Figures 34A, 34B:
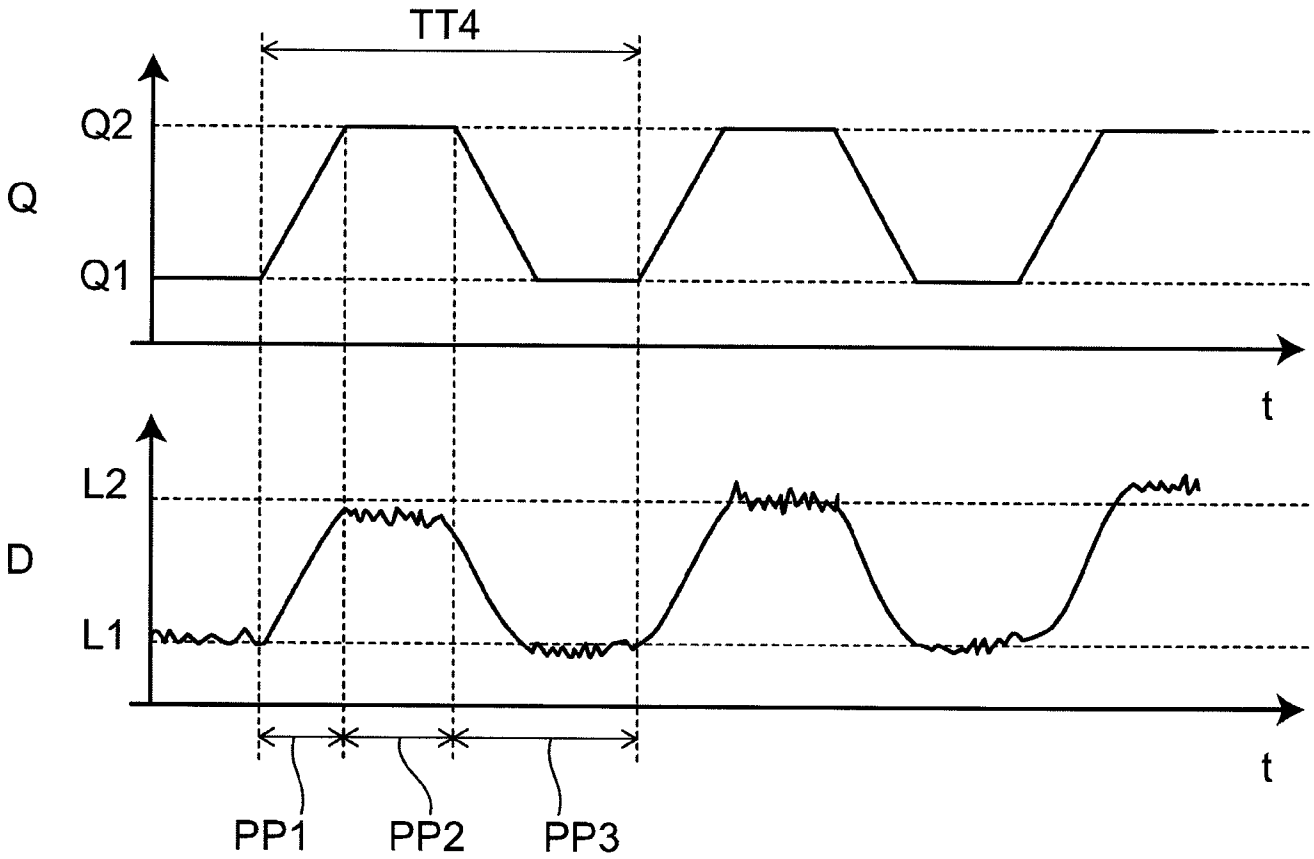
FIGS. 34A and 34B show the relationship between the jetting flow rate of the bathtub device according to the embodiment of the invention and the state of the leg of a bather.

FIGS. 34A and 34B are graphs illustrating still another specific example of the variation of the jetting flow rate from the jetting unit with respect to time and the variation of the distance from the second bathtub wall surface to the sole with respect to time.

Figure 35:
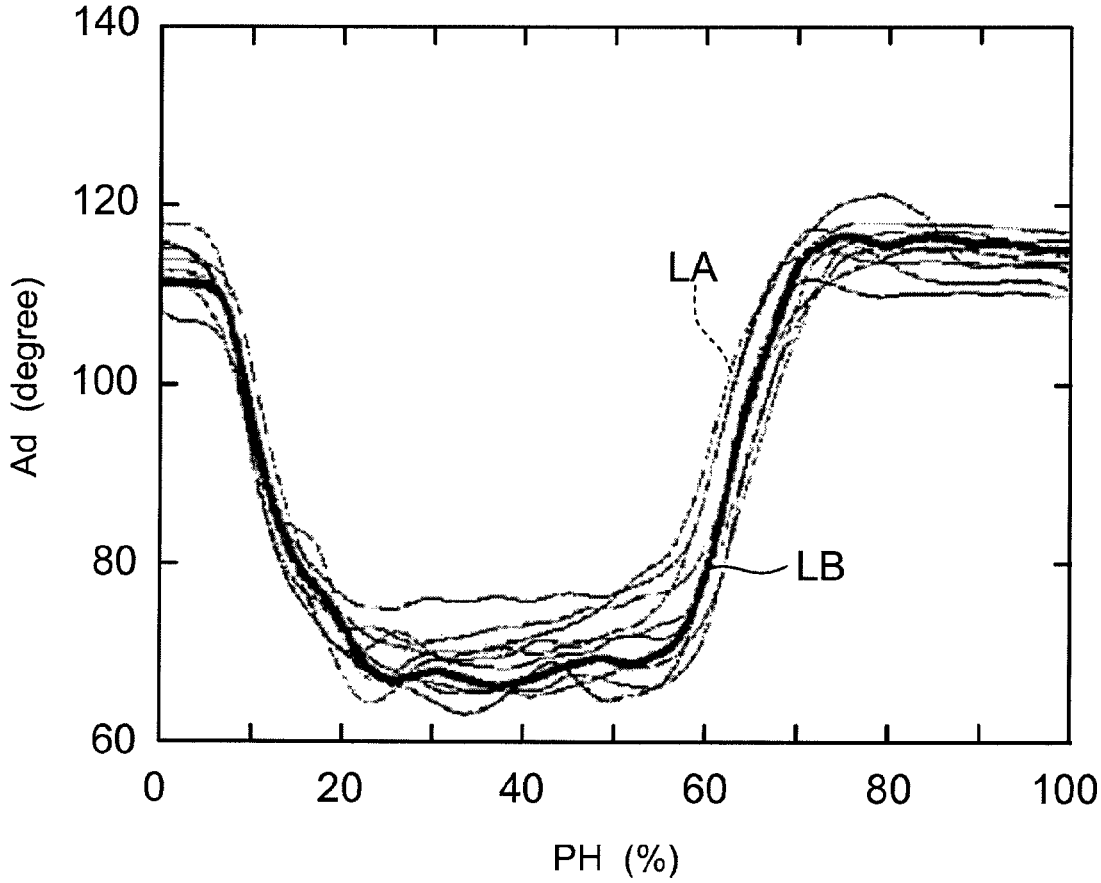
FIG. 35 illustrates results of experimental use of the bathtub device according to the embodiment of the invention.

FIG. 35 is a graph illustrating the knee joint angle with respect to phase in using a bathtub device according to this specific example.

FIG. 34A shows the variation with respect to time of the jetting flow rate Q of jet flow from the jetting unit 3. The horizontal axis represents time t, and the vertical axis represents the jetting flow rate Q. FIG. 34B shows the variation with respect to time of the distance D from the second bathtub wall surface 2*b* to the sole m2. The horizontal axis represents time t, and the vertical axis represents the distance D.

As shown in FIG. 34A, in this specific example, the cycle TT4 is relatively long, and the duty ratio is relatively high. The cycle TT4 of the jet flow state in this specific example is e.g. approximately 6 seconds. The first jet flow state (jetting flow rate Q1) and the second jet flow state (jetting flow rate Q2) are alternately switched.

In this specific example, the cycle TT is relatively long, and the duty ratio is relatively high. In this case, as shown in FIG. 34B, the duration of retain phase PP2 when the ankle joint, knee joint, and hip joint of the bather M are simultaneously bent and stopped, and the duration of stretch phase PP3 when they are naturally stretched, are both relatively long. In contrast, the duration of bend phase PP1 when the ankle joint, knee joint, and hip joint of the bather M are bent is relatively short. This can also be determined from the measured values of the knee joint angle with respect to phase in using the bathtub device 1*f* according to this specific example.

The inventors measured the knee joint angle Ad with respect to phase for approximately 10 roundtrips in using the bathtub device 1*f* according to this specific example. An example of the measured values is as shown in FIG. 35.

In FIG. 35, the horizontal axis represents the phase PH in percentage during one roundtrip (one cycle), and the vertical axis represents the knee joint angle Ad of the subjects. Each thin line LA shown in FIG. 35 represents the measured value of the knee joint angle Ad for approximately 10 roundtrips of the foot of a subject. The thick line LB shown in FIG. 35 represents the average of the measured values of the knee joint angle Ad.

As seen also from the measured values shown in FIG. 35, as described above, the duration of retain phase when the knee joint of the bather M is bent and stopped, and the duration of stretch phase when it is naturally stretched, are both relatively long.

Furthermore, it is also found that each measured value (thin line LA) has large dispersion, and has large variation from the average (thick line LB). That is, the bather M is caused to lose the balance of the posture by this exercise and takes an unstable posture. Hence, the bather M performs a compensating motion for unconsciously exerting the muscles throughout the body to stabilize the posture. Thus, the exercise of the leg of the bather M in this case is similar to stretching exercise or balance training.

Figure 36A:
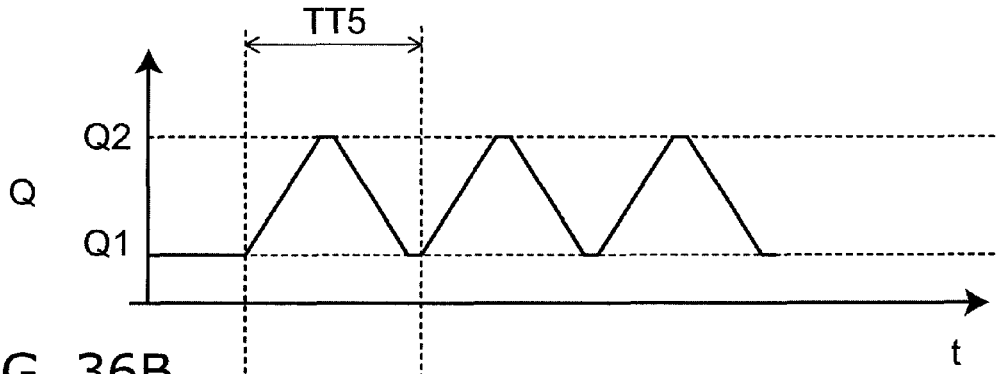
FIGS. 36A and 36B show the relationship between the jetting flow rate of the bathtub device according to the embodiment of the invention and the state of the leg of a bather.
Figure 36B:
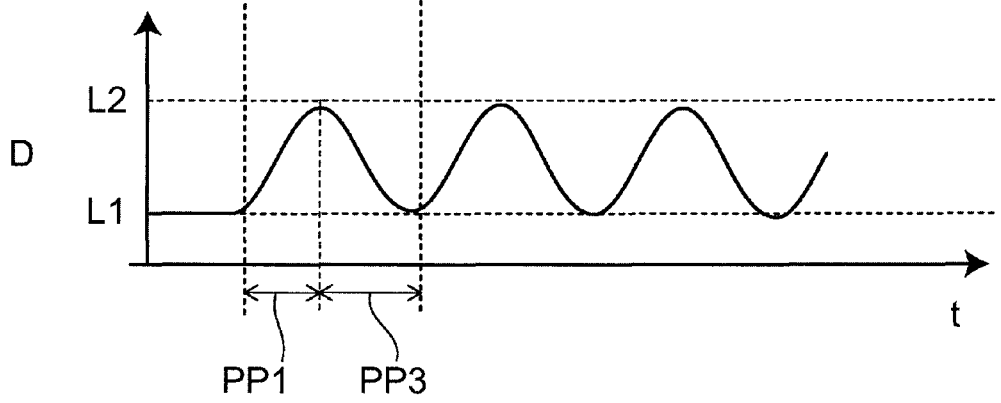

FIGS. 36A and 36B are graphs illustrating still another specific example of the variation of the jetting flow rate from the jetting unit with respect to time and the variation of the distance from the second bathtub wall surface to the sole with respect to time.

Figure 37:
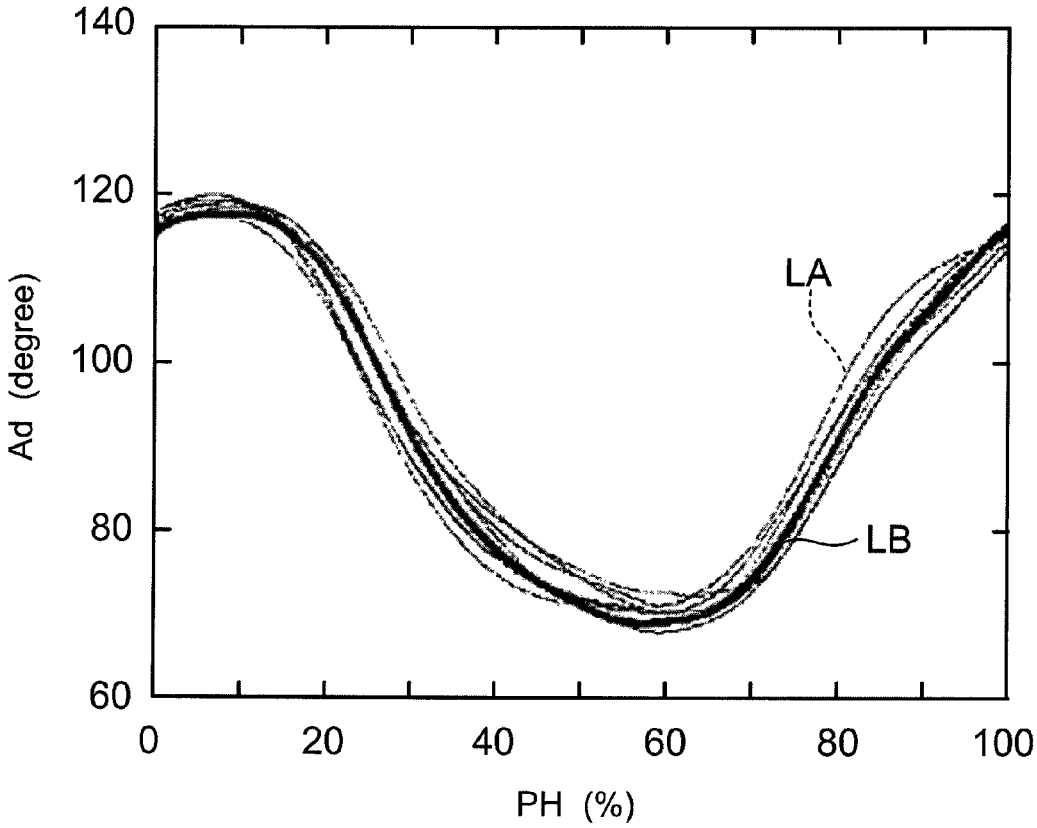
FIG. 37 illustrates results of experimental use of the bathtub device according to the embodiment of the invention.

FIG. 37 is a graph illustrating the knee joint angle with respect to phase in using a bathtub device according to this specific example.

As shown in FIG. 36A, in this specific example, the cycle TT5 is short, and the duty ratio is relatively low. The cycle TT5 of the jet flow state in this specific example is e.g.

approximately 2 seconds. The first jet flow state (jetting flow rate Q1) and the second jet flow state (jetting flow rate Q2) are alternately switched.

In this specific example, the cycle TT5 is relatively short, and the duty ratio is relatively low. In this case, as shown in FIG. 36B, the duration of bend phase PP1 when the ankle joint, knee joint, and hip joint of the bather M are bent, and the duration of stretch phase PP3 when they are naturally stretched, are relatively short. Furthermore, the duration of retain phase when the ankle joint, knee joint, and hip joint of the bather M are simultaneously bent and stopped does not substantially exist. That is, the left and right feet of the bather M reciprocate generally continuously in opposite phase. The stationary state does not substantially exist. This can also be determined from the measured values of the knee joint angle with respect to phase in using the bathtub device 1*f* according to this specific example.

The inventors measured the knee joint angle Ad with respect to phase for approximately 10 roundtrips in using the bathtub device 1*f* according to this specific example. An example of the measured values is as shown in FIG. 37.

Like the thin line LA shown in FIG. 35, the thin line LA shown in FIG. 37 represents the measured value of the knee joint angle Ad for approximately 10 roundtrips of the foot of each subject. Like the thick line LB shown in FIG. 35, the thick line LB shown in FIG. 37 represents the average of the measured values of the knee joint angle Ad.

As seen also from the measured values shown in FIG. 37, as described above, the duration of bend phase PP1 when the ankle joint, knee joint, and hip joint of the bather M are bent, and the duration of stretch phase PP3 when they are naturally stretched, are relatively short. Furthermore, the duration of retain phase when the ankle joint, knee joint, and hip joint of the bather M are simultaneously bent and stopped does not substantially exist.

Furthermore, it is also found that each measured value (thin line LA) has small dispersion, and has small variation from the average (thick line LB). That is, the bather M takes a stable posture by this exercise. Thus, the exercise of the leg of the bather M in this case is a bending/stretching exercise similar to walking exercise.

As described above, by varying the cycle and duty ratio of the state of jet flow from the jetting unit 3, the exercise mode of the bather M can be changed. That is, by varying the cycle of the state of jet flow from the jetting unit 3, the bather M can change between an exercise similar to stretching exercise or balance training, and a bending/stretching exercise like walking exercise. Thus, the bather M can continue these exercises without being bored with exercise. With regard to other effects, similar effects to those described earlier can be achieved.

As described above, according to this embodiment, at least one of the cycle and duty ratio of the state of jet flow from the jetting unit 3 can be varied. This is equivalent to the ability of varying the jetting time of jet flow from the jetting unit 3. By varying at least one of the cycle and duty ratio of the state of jet flow from the jetting unit 3, the bather M can change the exercise mode among, for instance, an exercise similar to stretching exercise, an exercise similar to balance training, and a bending/stretching exercise like walking exercise. Thus, the bather M can continue these exercises without being bored with exercise. That is, it can be said that the bathtub device according to this embodiment is an exercise bathtub device capable of causing a bather to do various kinds of passive exercises without habituation.

The embodiments of the invention have been described above. However, the invention is not limited to the above description. The above embodiments can be suitably modified by those skilled in the art. Such modifications are also encompassed within the scope of the invention as long as they include the features of the invention. For instance, the shape, dimension, material, and layout of each component in the jetting unit 3 and the jetting driving unit 4, and the installation configuration of the jetting unit 3 are not limited to those illustrated, but can be suitably modified. More specifically, the above description of the embodiments is primarily based on examples in which jet flow is jetted from the first and second jetting units 3L and 3R. However, the jet flow may be jetted from one of the first and second jetting units 3L and 3R. In this case, the bather M does exercise of one of the left and right legs.

Furthermore, the components in the above embodiments can be combined as long as technically feasible. Such combinations are also encompassed within the scope of the invention as long as they include the features of the invention.

INDUSTRIAL APPLICABILITY

According to the invention, a bathtub device capable of causing a bather to exercise continually can be provided.

EXPLANATION OF REFERENCE

1, 1*a*, 1*c*, 1*d*, 1*e*, 1*f* bathtub device
2 bathtub
2*a* first bathtub wall surface
2*b* second bathtub wall surface
2*c* bottom surface
2*d* bathtub sidewall surface
3 jetting unit
3L first jetting unit
3R second jetting unit
4 jetting driving unit
4L first jetting driving unit
4R second jetting driving unit
4*s* suction port
5 controller
A1, a1 to a3 time
Ad knee joint angle
BS bent state
D, D1, D2 distance
DB amount of foot movement
DR duty ratio
DS, DS1, DS2, DS3 trajectory stability index
E1 stretching exercise
E2 walking exercise
E3 balance training
EM exercise mode
L solid line
L1, L2 distance
LA thin line
LB thick line
LS state of leg
LSL, LSR state
M bather
M1 gastrocnemius muscle
M2 quadriceps femoris muscle
M3 erector spinae muscle
M4 hamstrings
M5 tibialis anterior muscle
M6 forearm muscle group
MA amount of muscle activity
PA to PD, P1 to P7 subject
PH phase PL, PS site
PP1 bend phase
PP2 retain phase
PP3 stretch phase
PS site
Q, QL, QR, Q4 jetting flow rate
Q1, Q2 jetting flow rate
QB, QS value
Q0 target jetting flow rate
Qa prescribed value
Qb prescribed jet flow value
Qdown jetting state
Qi initial jetting flow rate
Qmax maximum value
Qup state
RQ respiratory quotient
RQ1 respiratory quotient in embodiment
RQ2 respiratory quotient in comparative example
RQR fat burning region
RT ratio
SS relatively stretched state
S1, S2 time
TT, TT1 to TT5 cycle
T1 to T4, T21 to T24, tb1 to tb4 operating state
Tq jetting flow rate rise time
Tv voltage rise time
V1 application voltage
V10 target application voltage
W water
m1 back
m2 sole
m3, m5, m6, m7 muscle group
m4 inner muscle
n3 trunk
n4 hip joint
n5 thigh
n6 lower leg
n7 foot
t time
t1 to t4, t11 to 13, tc1 to tc4 time
tp time

What is claimed is:

1. A bathtub device comprising:

a bathtub including a first bathtub wall surface and a second bathtub wall surface opposed to the first bathtub wall surface;

a jetting unit provided in the second bathtub wall surface and including a first jetting unit and a second jetting unit, the first jetting unit being configured to jet a jet flow to a left sole of a bather bathing in the bathtub, the second jetting unit being configured to jet a jet flow to a right sole of the bather bathing in the bathtub;

a jetting driving unit connected to the jetting unit and configured to adjust jetting flow rate of the jet flow jetted from the jetting unit; and a controller configured to control the jetting driving unit, the controller being configured to control the jetting driving unit to cause the first jetting unit to alternately perform a first operation and a second operation, the first operation including jetting a first jet flow with a first high flow rate, the second operation including jetting a second jet flow with a first low flow rate or not jetting the jet flow, the first low flow rate being lower than the first high flow rate, the first operation being configured to cause a left leg of the bather being passively bent with the first operation and the second operation being configured to cause the left leg being stretched with the second operation, the controller being configured to control the jetting driving unit to cause the second jetting unit to alternately perform a third operation and a fourth operation, the third operation including jetting a third jet flow with a second high flow rate, the fourth operation including jetting a fourth jet flow with a second low flow rate or not jetting the jet flow, the second low flow rate being lower than the second high flow rate, the third operation being configured to cause a right leg of the bather being passively bent with the third operation and the fourth operation being configured to cause the right leg being stretched with the fourth operation, the controller being configured to control the jetting driving unit to perform alternately the first operation and the third operation to cause the left leg and the right leg to alternately bend and stretch to cause a walking motion.

2. The bathtub device according to claim 1, wherein the jetting driving unit includes a first jetting driving unit connected to the first jetting unit and a second jetting driving unit connected to the second jetting unit.

3. The bathtub device according to claim 1, wherein the first jetting unit and the second jetting unit are a pair of jetting units arranged horizontally.

4. The bathtub device according to claim 1, wherein the controller is capable of setting a state of the jet flow jetted from the jetting unit to a first jet flow state not jetting the first jet flow, and a second jet flow state jetting the first jet flow, and capable of varying duration of at least one of the first and second jet flow states, the controller is capable of setting a state of the jet flow jetted from the jetting unit to a third jet flow state not jetting the third jet flow, and a fourth jet flow state jetting the third jet flow, and capable of varying duration of at least one of the third and fourth jet flow states.

5. The bathtub device according to claim 4, wherein the controller is capable of varying ratio of the duration of the first and second jet flow states to cycle of change of the state of the jet flow jetted from the jetting unit, and the controller is capable of varying ratio of the duration of the third and fourth jet flow states to cycle of change of the state of the jet flow jetted from the jetting unit.

6. The bathtub device according to claim 4, wherein the controller is capable of varying the cycle of change of the state of the jet flow jetted from the jetting unit.

7. The bathtub device according to claim 1, wherein the controller is configured to control the jetting driving unit increasing a flow rate of jet flow jetting from one of the first jetting unit and the second jetting unit while decreasing a flow rate of jet flow jetting from the other of the first jetting unit and the second jetting unit.

* * * * *

UNITED STATES PATENT AND TRADEMARK OFFICE

CERTIFICATE OF CORRECTION

PATENT NO. : 8,561,223 B2
APPLICATION NO. : 13/061728
DATED : October 22, 2013
INVENTOR(S) : Minoru Sato et al.

It is certified that error appears in the above-identified patent and that said Letters Patent is hereby corrected as shown below:

In the Specification

Column 7, line 63, please replace “n” with -- t1 --

Signed and Sealed this
Thirty-first Day of December, 2013

Margaret A. Focarino

Margaret A. Focarino
*Commissioner for Patents of the United States Patent and Trademark Office*